US010269199B2

(12) United States Patent
Lickfelt

(10) Patent No.: US 10,269,199 B2
(45) Date of Patent: Apr. 23, 2019

(54) SYSTEM AND METHOD FOR PROVIDING ENERGY EFFICIENT HANDS FREE VEHICLE DOOR OPERATION

(71) Applicant: Honda Motor Co., Ltd., Tokyo (JP)

(72) Inventor: Brian K. Lickfelt, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/716,742

(22) Filed: Sep. 27, 2017

(65) Prior Publication Data

US 2019/0096151 A1 Mar. 28, 2019

(51) Int. Cl.
*G07C 9/00* (2006.01)
*E05B 81/78* (2014.01)

(52) U.S. Cl.
CPC ..... *G07C 9/00309* (2013.01); *E05B 81/78* (2013.01); *G07C 2009/00357* (2013.01); *G07C 2009/00388* (2013.01); *G07C 2209/08* (2013.01); *G07C 2209/63* (2013.01)

(58) Field of Classification Search
CPC ..... G07C 9/00309; G07C 2009/00357; G07C 2009/00388; G07C 2209/08; G07C 2209/63; G07C 2009/00333; E05B 81/78; B60R 25/24; B60R 25/245; B60R 25/246
USPC ..... 340/5.61, 5.72
See application file for complete search history.

(56) References Cited

U.S. PATENT DOCUMENTS 5,602,831 A 2/1997 Gaskill
5,809,013 A 9/1998 Kackman
6,023,475 A 2/2000 Tanaka et al.
6,218,932 B1 * 4/2001 Stippler ..... B60R 25/04 307/10.2
6,421,720 B2 7/2002 Fitzgerald
6,498,970 B2 12/2002 Colmenarez et al.
6,617,961 B1 * 9/2003 Janssen ..... B60R 25/245 307/10.1
6,886,040 B1 4/2005 Fitzgerald
6,937,136 B2 * 8/2005 Greenwood ..... B60R 25/246 340/5.61
6,990,317 B2 1/2006 Arnold
7,058,027 B1 6/2006 Alessi et al.
7,061,428 B1 6/2006 Amir et al.
7,142,090 B2 11/2006 Ueda et al.
7,193,506 B2 3/2007 Logvinov et al.
7,257,758 B1 8/2007 Manula et al.
7,292,137 B2 11/2007 Gilbert et al.
7,551,057 B2 6/2009 King et al.
(Continued)

*Primary Examiner* — Edwin C Holloway, III
(74) *Attorney, Agent, or Firm* — Rankin, Hill & Clark LLP

(57) ABSTRACT

A method and system for providing energy efficient hands free vehicle door operation that includes receiving a first LF polling signal of a pair of LF polling signals and creating a first RF polling response message packet in response to the first LF polling signal. The method and system also include receiving a second LF polling signal of the pair of LF polling signals and creating a second RF polling response message packet in response to the second LF polling signal. The method and system further include aggregating the first RF polling response message packet and the second RF polling response message packet into an aggregated RF polling response message packet that is contained within an aggregated RF polling response signal that is transmitted from a portable device to a vehicle in response to the pair of LF polling signals.

20 Claims, 7 Drawing Sheets

(56) References Cited

U.S. PATENT DOCUMENTS

| | | | | |
|---|---|---|---|---|
| 7,915,998 | B2 * | 3/2011 | Matsubara | G07C 9/00309 340/5.1 |
| 8,228,910 | B2 | 7/2012 | Wu et al. | |
| 8,498,280 | B2 | 7/2013 | Das et al. | |
| 8,750,298 | B2 | 6/2014 | Wu et al. | |
| 9,086,879 | B2 | 7/2015 | Gautama et al. | |
| 9,240,822 | B2 | 1/2016 | Jiang et al. | |
| 9,483,935 | B2 | 11/2016 | Carlson et al. | |
| 2008/0002655 | A1 | 1/2008 | Logvinov et al. | |
| 2008/0069347 | A1 * | 3/2008 | Brown | H04L 9/3066 380/45 |
| 2008/0279219 | A1 * | 11/2008 | Wu | H04L 45/00 370/474 |
| 2014/0022969 | A1 | 1/2014 | Ryshakov et al. | |
| 2014/0159865 | A1 * | 6/2014 | Eto | G07C 9/00126 340/5.61 |
| 2014/0215567 | A1 * | 7/2014 | Yoshizawa | H04W 12/06 726/3 |
| 2016/0307384 | A1 | 10/2016 | Sampei | |
| 2016/0337763 | A1 | 11/2016 | Zhang et al. | |
| 2016/0358451 | A1 | 12/2016 | Adler et al. | |

* cited by examiner

SYSTEM AND METHOD FOR PROVIDING ENERGY EFFICIENT HANDS FREE VEHICLE DOOR OPERATION

BACKGROUND

Many vehicles today include systems that may allow powered opening and closing of vehicle doors that include a tailgate door. Many of these systems require an individual to perform some type of action to instruct the systems that the vehicle door should be opened or closed. For example, some systems require individuals to perform specific actions in a specific manner once a key fob held by the individual is determined to be in a predetermined vicinity of the vehicle in order to instruct the systems to actuate powered opening or closing of the vehicle door. In many cases, the presence of the key fob within a predetermined vicinity of the vehicle door is determined based on a continuous transmission of LF polling signals by a vehicle and a transmission of corresponding RF polling response signals by the key fob that are sent in response to each of the continuous LF polling signals. This continuous polling and responding may occur within a rapid frequency (e.g., every 100-500 ms) causing a high load on the battery of the key fob as the key fob responds to each of the LF polling signals continuously received. Therefore, expiration of charging power of the battery of the key fob may rapidly occur thereby disallowing the functionality of the key fob for a prolonged period of time and limiting the functionality with respect to powered opening and closing of vehicle doors.

BRIEF DESCRIPTION

According to one aspect, a computer-implemented method for providing energy efficient hands free vehicle door operation that includes receiving a first LF polling signal of a pair of LF polling signals transmitted from a vehicle to a portable device and creating a first RF polling response message packet in response to the first LF polling signal. The first RF polling response message packet includes a first data payload portion that includes data that pertains to a location of the portable device. The method also includes receiving a second LF polling signal of the pair of LF polling signals transmitted from the vehicle to the portable device and creating a second RF polling response message packet in response to the second LF polling signal. The second RF polling response message packet includes a second data payload portion that includes data that pertains to the location of the portable device. The method further includes aggregating the first RF polling response message packet and the second RF polling response message packet into an aggregated RF polling response message packet that is contained within an aggregated RF polling response signal that is transmitted from the portable device to the vehicle in response to the pair of LF polling signals. A received signal strength of the aggregated RF polling response signal is evaluated to determine actuation of a powered unlocking, opening, locking and closing of at least one vehicle door.

According to another aspect, a system for providing hands free operation of at least one vehicle door is provided. The system includes a memory storing instructions that, when executed by a processor, cause the processor to receive a first LF polling signal of a pair of LF polling signals transmitted from a vehicle to a portable device and create a first RF polling response message packet in response to the first LF polling signal. The first RF polling response message packet includes a first data payload portion that includes data that pertains to a location of the portable device. The instructions also cause the processor to receive a second LF polling signal of the pair of LF polling signals transmitted from the vehicle to the portable device and create a second RF polling response message packet in response to the second LF polling signal. The second RF polling response message packet includes a second data payload portion that includes data that pertains to the location of the portable device. The instructions further cause the processor to aggregate the first RF polling response message packet and the second RF polling response message packet into an aggregated RF polling response message packet that is contained within an aggregated RF polling response signal that is transmitted from the portable device to the vehicle in response to the pair of LF polling signals. A received signal strength of the aggregated RF polling response signal is evaluated to determine actuation of a powered unlocking, opening, locking and closing of at least one vehicle door.

According to still another aspect, a non-transitory computer readable storage medium stores instructions that, when executed by a computer, which includes at least a processor, causes the computer to perform a method that includes receiving a first LF polling signal of a pair of LF polling signals transmitted from a vehicle to a portable device and creating a first RF polling response message packet in response to the first LF polling signal. The first RF polling response message packet includes a first data payload portion that includes data that pertains to a location of the portable device. The method also includes receiving a second LF polling signal of the pair of LF polling signals transmitted from the vehicle to the portable device and creating a second RF polling response message packet in response to the second LF polling signal. The second RF polling response message packet includes a second data payload portion that includes data that pertains to the location of the portable device. The instructions further include aggregating the first RF polling response message packet and the second RF polling response message packet into an aggregated RF polling response message packet that is contained within an aggregated RF polling response signal that is transmitted from the portable device to the vehicle in response to the pair of LF polling signals. A received signal strength of the aggregated RF polling response signal is evaluated to determine actuation of a powered unlocking, opening, locking and closing of at least one vehicle door.

DETAILED DESCRIPTION

Figure 1:
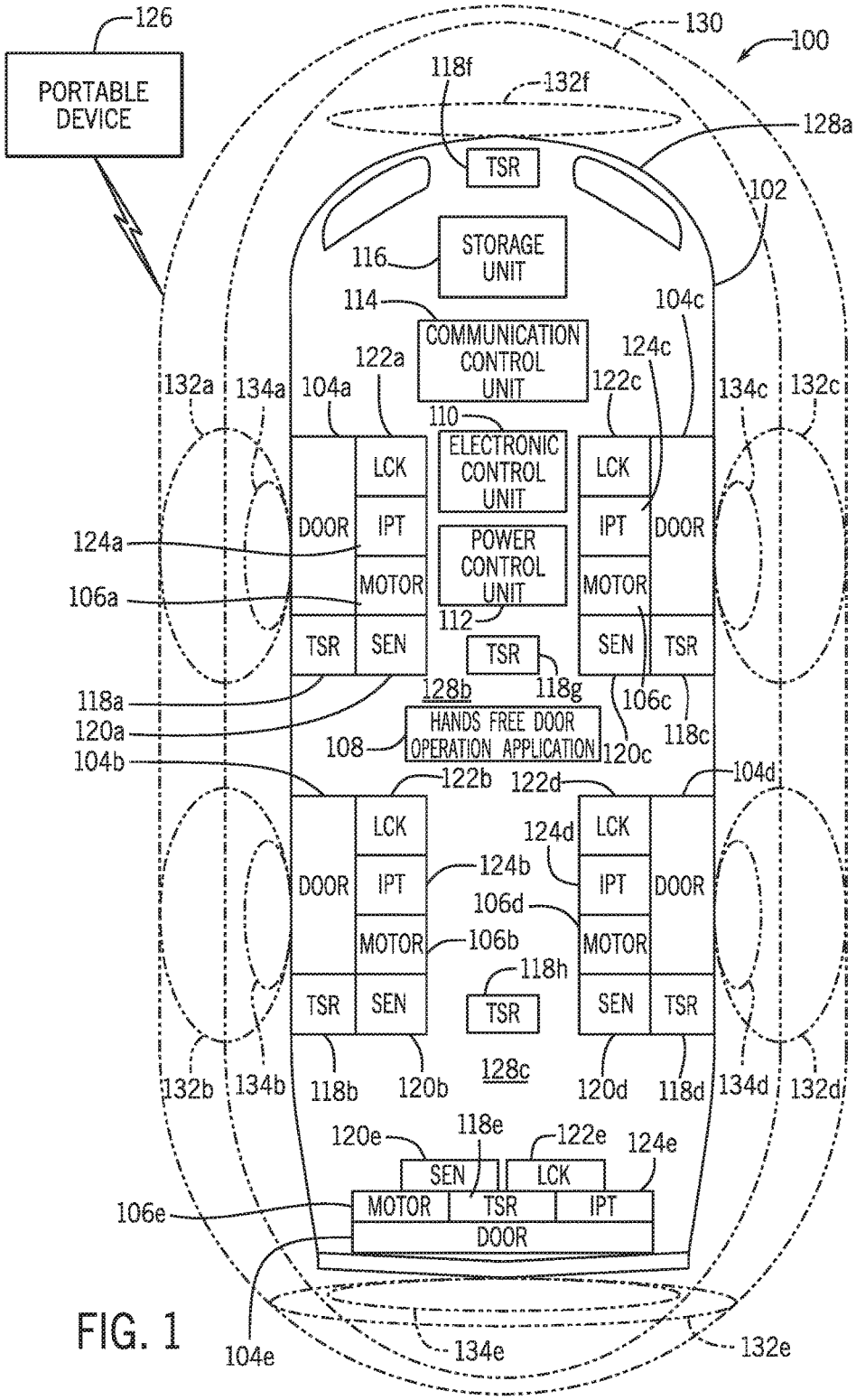
FIG. 1 illustrates a schematic view of an exemplary operating environment of an energy efficient smart entry hands free system within a vehicle for reducing battery consumption of a portable device during hands free operation of at least one vehicle door according to an exemplary embodiment of the present disclosure.

The following includes definitions of selected terms employed herein. The definitions include various examples and/or forms of components that fall within the scope of a term and that can be used for implementation. The examples are not intended to be limiting.

A "bus,' as used herein, refers to an interconnected architecture that is operably connected to transfer data between computer components within a singular or multiple systems. The bus can be a memory bus, a memory controller, a peripheral bus, an external bus, a crossbar switch, and/or a local bus, among others. The bus can also be a vehicle bus that interconnects components inside a vehicle using protocols such as Controller Area network (CAN), Media Oriented System Transport (MOST), Local Interconnect Network (LIN), among others.

"Computer communication", as used herein, refers to a communication between two or more computing devices (e.g., computer, personal digital assistant, cellular telephone, network device) and can be, for example, a network transfer, a file transfer, an applet transfer, an email, a hypertext transfer protocol (HTTP) transfer, and so on. A computer communication can occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, among others.

An "input device" as used herein can include devices for controlling different vehicle features which include various vehicle components, systems, and subsystems. The term "input device" includes, but it not limited to: push buttons, rotary knobs, and the like. The term "input device" additionally includes graphical input controls that take place within a user interface which can be displayed by various types of mechanisms such as software and hardware based controls, interfaces, or plug and play devices.

A "memory," as used herein can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

A "module", as used herein, includes, but is not limited to, hardware, firmware, software in execution on a machine, and/or combinations of each to perform a function(s) or an action(s), and/or to cause a function or action from another module, method, and/or system. A module can include a software controlled microprocessor, a discrete logic circuit, an analog circuit, a digital circuit, a programmed logic device, a memory device containing executing instructions, and so on.

An "operable connection," as used herein can include a connection by which entities are "operably connected", is one in which signals, physical communications, and/or logical communications can be sent and/or received. An operable connection can include a physical interface, a data interface and/or an electrical interface.

An "output device" as used herein can include devices that can derive from vehicle components, systems, subsystems, and electronic devices. The term "output devices" includes, but is not limited to: display devices, and other devices for outputting information and functions.

A "processor", as used herein, processes signals and performs general computing and arithmetic functions. Signals processed by the processor can include digital signals, data signals, computer instructions, processor instructions, messages, a bit, a bit stream, or other means that can be received, transmitted and/or detected. Generally, the processor can be a variety of various processors including multiple single and multicore processors and co-processors and other multiple single and multicore processor and co-processor architectures. The processor can include various modules to execute various functions.

A "vehicle", as used herein, refers to any moving vehicle that is capable of carrying one or more human occupants and is powered by any form of energy. The term "vehicle" includes, but is not limited to: cars, trucks, vans, minivans, SUVs, motorcycles, scooters, boats, personal watercraft, and aircraft. In some cases, a motor vehicle includes one or more engines.

A "vehicle system", as used herein can include, but are not limited to, any automatic or manual systems that can be used to enhance the vehicle, driving and/or safety. Exemplary vehicle systems include, but are not limited to: an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a transmission system, brake pedal systems, an electronic power steering system, visual devices (e.g., camera systems, proximity sensor systems), a climate control system, an electronic pretensioning system, among others.

A "value" and "level", as used herein can include, but is not limited to, a numerical or other kind of value or level such as a percentage, a non-numerical value, a discrete state, a discrete value, a continuous value, among others. The term "value of X" or "level of X" as used throughout this detailed description and in the claims refers to any numerical or other kind of value for distinguishing between two or more states of X. For example, in some cases, the value or level of X may be given as a percentage between 0% and 100%. In other cases, the value or level of X could be a value in the range between 1 and 10. In still other cases, the value or level of X may not be a numerical value, but could be associated with a given discrete state, such as "not X", "slightly x", "x", "very x" and "extremely x".

I. System Overview

Referring now to the drawings, wherein the showings are for purposes of illustrating one or more exemplary embodiments and not for purposes of limiting the same, FIG. 1 illustrates a schematic view of an exemplary operating environment of an energy efficient smart entry hands free system 100 of a vehicle 102 and a portable device 126 for reducing battery consumption of the portable device 126 during hands free operation of at least one vehicle door 104*a*-104*e* according to an exemplary embodiment of the present disclosure. The components of the system 100, as well as the components of other systems, hardware architectures and software architectures discussed herein, can be combined, omitted or organized into different architecture for various embodiments. However, the exemplary embodiments discussed herein focus on the environment as illustrated in FIG. 1, with corresponding system components, and related methods.

Figure 2:
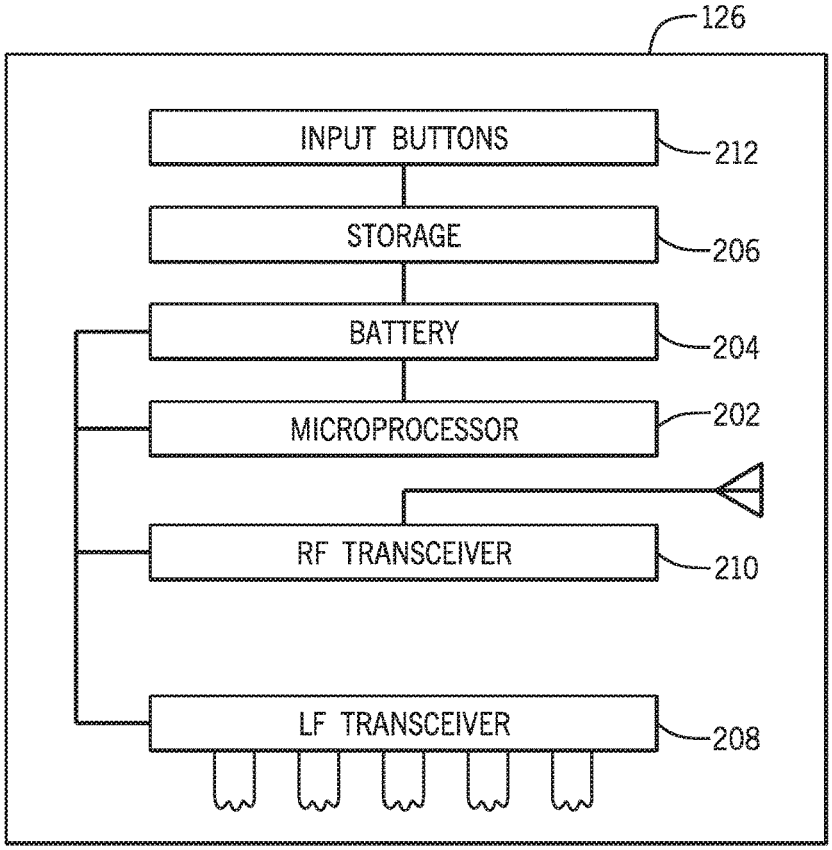
FIG. 2 illustrates a schematic view of an exemplary portable device of the energy efficient smart entry hands free system according to an exemplary embodiment of the present disclosure.

With reference to FIG. 1 and FIG. 2, in an exemplary embodiment, the system 100 may be utilized by a portable device 126 (e.g., key fob) that may be operated in an energy efficient mode. In one or more embodiments, the energy efficient mode may be enabled by default and may also be disabled and/or re-enabled based on a user input. During enablement of the energy efficient mode of the portable device 126, the portable device 126 may transmit a reduced number of RF response signal transmissions to the vehicle 102 based on the reception of a plurality of continuous LF polling signals that are transmitted from the vehicle 102 (e.g., at a rapid rate of every 100 ms-500 ms apart). As discussed in more detail below, the system 100 may be utilized to transmit a single aggregated RF response signal by aggregating (e.g., doubling, combining) data payload portions of two RF response message packets that are transmitted in the form of the single aggregated RF polling response signal. In other words, during the enablement of the energy efficient mode, the portable device 126 may transmit the aggregated RF polling response signal in response to the reception of two received LF polling signals. When the energy efficient mode is disabled, the portable device 126 may transmit two RF polling response signals in response to the reception of the two received LF polling signals.

Consequently, when the energy efficient mode of the portable device 126 is enabled, the system 100 ensures that the portable device 126 transmits the aggregated RF response signal that includes a packet with an aggregated data payload portion rather than transmitting two separate RF polling response signals that each include a packet with two respective data payload portions in response to two LF polling signals received from the vehicle 102. This functionality may result in the transmission of a plurality of RF polling response signals at a lower response rate during a fixed period of time, thereby reducing an overall RF transmission time and reducing a load on battery 204 of the portable device 126.

As additionally discussed below (with respect to FIGS. 4A and 4B), during enablement of the energy efficient mode, the system 100 may ensure additional portions of the two RF polling response signals that include, but may not be limited to, a header portion, a fixed code (cryptology) portion, a rolling code portion, and a check-sum portion are added as non-aggregated portions within the aggregated RF response message packet contained within the aggregated RF response signal. More specifically, the duplication of the aforementioned portions may be eliminated within the aggregated RF polling response and the data payload portions may be aggregated to be added within the aggregated RF response message packet that is contained within the RF polling response signal transmitted from the portable device 126 to the vehicle 102. As discussed in more detail below, one or more aggregated RF polling response signals may be utilized by the system 100 to provide hands free operation of the at least one vehicle door 104*a*-104*e*. In particular, the evaluation of the location of the received aggregated RF polling response signals may be used to automate a powered unlocking and locking of one or more locks 122*a*-122*e* of one or more vehicle doors 104*a*-104*e* of the vehicle 102 by one or more motors 106*a*-106*e* associated with one or more of the respective vehicle doors 104*a*-104*e*. Additionally, the evaluation of the location of the received aggregated RF polling response signals may be used to automate a powered opening and closing of one or more vehicle doors 104*a*-104*e* of the vehicle 102 by one or more motors 106*a*-106*e* associated with one or more of the respective vehicle doors 104*a*-104*e*.

With reference to FIG. 1 and FIG. 2, as described in more detail below, the creation and evaluation of the aggregated RF polling response signal(s), the automated unlocking and locking of the one or more locks 122*a*-122*e* of the one or more vehicle doors 104*a*-104*e*, and the automated powered opening and closing of one or more of the vehicle doors 104*a*-104*e* may be based on one or more execution commands sent by a hands free door operation application 108 (hereinafter referred to as hands free door application) executed by an electronic control unit 110 (ECU) of the vehicle 102 and a microprocessor 202 of the portable device 126. The commands may be provided based on determinations that an authorized individual who is holding the portable device 126 is located within a predetermined vicinity of the vehicle 102 that is located outside of a space occupied by the vehicle door(s) 104*a*-104*e* and is stationary within the predetermined vicinity of the vehicle 102 for a predetermined period of time. This determination may be made based on the reception and evaluation of aggregated data payload portions that include data that pertains to the location of the portable device 126 contained within one or more aggregated RF polling response signals transmitted by the portable device 126 as the energy efficient mode of the portable device 126 is enabled. Additionally, in one embodiment, the hands free door application 108 may provide commands to provide an amount of power to close one or more of the vehicle doors 104*a*-104*e* based on an evaluation of one or more aggregated RF polling response signals transmitted by the portable device 126 as the energy efficient mode of the portable device 126 is enabled.

In an exemplary embodiment, the ECU 110 operably controls the vehicle 102 and its components that may include, but are not limited to the components shown in FIG. 1. The ECU 110 may include a microprocessor, one or more application-specific integrated circuit(s) (ASICs), or other similar devices. The ECU 110 may also include internal processing memory, an interface circuit, and bus lines for transferring data, sending commands, and communicating with the systems and components of the vehicle 102. Generally, the ECU 110 includes a processor and memory (not shown). The ECU 110 also includes a separate communications device (not shown) for sending data internally in the vehicle 102.

In one or more embodiments, in addition to the aforementioned components of the system 100, the vehicle 102 may include a power control unit 112, a communication control unit 114, a storage unit 116, one or more transceivers 118*a*-118*h*, one or more motion sensors 120*a*-120*e*, the door locks 122*a*-122*e*, and door input buttons 124*a*-124*e*. As discussed below, the communication control unit 114 of the vehicle 102 may utilize the one or more transceivers 118*a*-118*h* to continually transmit LF polling signals to the portable device 126 and receive RF polling response signals (e.g., that may include aggregated RF polling response signals) from the portable device 126.

In one embodiment, the storage unit 116 of the vehicle 102 may include various memories such as, for example L1, L2, or L3 cache or system memory. As such, the memory may include static random access memory (SRAM), dynamic RAM (DRAM), flash memory, read only memory (ROM), or other similar memory devices. The storage unit 116 may be utilized to store one or more operating systems, applications, associated operating system data, application data, vehicle system and subsystem user interface data, and the like that may be executed by the ECU 110.

In an exemplary embodiment, as described in more detail below, one or more of the vehicle doors 104*a*-104*e* may include, but may not be limited to, a left side front door 104*a*, a left side rear door 104*b*, a right side front door 104*c*, a right side rear door 104*d*, and a tailgate door 104*e*. One or more of the vehicle doors 104*a*-104*e* may include the associated motor 106*a*-106*e* that may operate the respective vehicle doors 104*a*-104*e* and the respective door locks 122*a*-122*e* based on signals sent and received from the hands free door application 108. In one or more embodiments, one or more of the vehicle doors 104*a*-104*e* may include an automatically lifting door (e.g., lift gate door), a swinging door, or sliding door (specific door configurations not shown) that may be manually opened or closed and/or opened or closed based on the operation of one or more of the associated motors 106*a*-106*e* that are supplied power by the power control unit 112 of the vehicle 102.

Additionally, the associated motor 106*a*-106*e* may operate the lock 122*a*-122*e* of each of the respective vehicle doors 104*a*-104*e* based on signals sent and received from the hands free door application 108. The lock(s) 122*a*-122*e* may function to be locked or unlocked by the respective motor 106*a*-106*e* based on the operation of one or more of the associated motors 106*a*-106*e* that are supplied power by the power control unit 112 of the vehicle 102. As discussed below, the unlocking or locking of the one or more door locks 122*a*-122*e*, and the opening or closing of the one or more vehicle doors 104*a*-104*e* may be determined based on processing completed by the hands free door application 108.

In one or more embodiments, the one or more doors 104*a*-104*e* may include the respective door input buttons 124*a*-124*e*. The door input buttons 124*a*-124*e* may communicate with various components of the vehicle 102 including the ECU 110 to partially control operation of one or more of the vehicle doors 104*a*-104*e*. For example, the door input buttons 124*a*-124*e* may be inputted by an individual to indicate that the individual intends for the tailgate door 104*e* to be closed upon walking away from the tailgate door 104*e*, entering the vehicle 102, placing an object(s) within the vehicle 102, and/or removing object(s) from the vehicle 102.

In an exemplary embodiment, the communication control unit 114 of the vehicle 102 is operably connected to the one or more transceivers 118*a*-118*h* in addition to the ECU 110, and the power control unit 112. The communication control unit 114 may be configured to control operation of the one or more transceivers 118*a*-118*h* to continually transmit the LF polling signals to the portable device 126. Additionally, the communication control unit 114 may be configured to control operation of the one or more transceivers 118*a*-118*h* to receive one or more RF polling response signals (e.g., that may include one or more aggregated RF polling response signals) from the portable device 126.

In one embodiment, the communication control unit 114 may send one or more commands to the transceiver(s) 118*a*-118*h* to send one or more pairs of LF polling signals at one or more signal strengths and at one or more frequencies based on one or more commands received by the communication control unit 114 from the hands free door application 108 and/or the ECU 110. Additionally, the communication control unit 114 may send the one or more commands to the transceiver(s) 118*a*-118*h* to send the one or more pairs of LF polling signals at one or more signal strengths and at one or more frequencies based on one or more amounts of power supplied to the transceivers(s) 118*a*-118*h* by the power control unit 112, as may be determined by the hands free door application 108 and/or the ECU 110.

In an exemplary embodiment, the one or more transceivers 118*a*-118*h* may be capable of providing wireless computer communications utilizing various protocols to be used to send/receive electronic signals internally to components and systems within the vehicle 102 and to external devices including the one or more portable devices 126. The one or more transceivers 118*a*-118*h* may include respective transmitter antennas (not shown) and receiver antennas (not shown) that may be separate components or may be configured as a single component. The one or more transceivers 118*a*-118*h* may be included at one or more areas of the vehicle 102 that may be utilized to determine a location of the portable device 126 and/or a movement of the portable device 126 with respect to the vehicle 102 and/or specifically with respect to one or more of the vehicle doors 104*a*-104*e* based on received signal strength (RSSI) measurements.

As discussed below, during the enablement of the energy efficient mode of the portable device 126, the RSSI measurements may be made based on an evaluation of the aggregated data payload portions of aggregated RF response message packets contained within the received aggregated RF polling response signals transmitted by the portable device 126. As shown in FIG. 1, transceivers 118*a*-118*h* may be provided within a vicinity of each of the vehicle doors 104*a*-104*e*, at a front portion 128*a* of the vehicle 102, at a middle portion 128*b* of the vehicle 102, and at a rear portion 128*c* (e.g., trunk) of the vehicle 102 to continually transmit LF polling signals and receive the aggregated RF polling response signals from the portable device 126 located within a vicinity of the vehicle 102.

In one or more embodiments, the one or more transceivers 118*a*-118*h* may be operably controlled to continually transmit the LF polling signals to a plurality of zones (e.g., areas around the vehicle 102/one or more vehicle doors 104*a*-104*e*) at one or more predetermined polling frequencies. In one embodiment, the plurality of zones may include a wide area polling zone 130 and local area polling zones 132*a*-132*f* that include a predetermined area(s) around the vehicle 102. In particular, the local area polling zones 132*a*-132*f* may include predetermined area(s) around the vehicle 102 that are in close proximity (near) the respective vehicle door(s) 104*a*-104*e*.

In an exemplary embodiment, predetermined areas within the local area polling zones 132*a*-132*e* (located near the respective vehicle doors 104*a*-104*e*) may be identified as a plurality of door area zones 134*a*-134*e*. In particular, the plurality of door area zones 134*a*-134*e* may include the predetermined areas within the local area polling zones 132*a*-132*e* that include a space that may be occupied by the respective vehicle door(s) 104*a*-104*e* when the vehicle door(s) 104*a*-104*e* is being opened or closed. The door area zones 134*a*-134*e* may represent respective areas near the vehicle doors 104*a*-104*e* that may be deemed as a space where individuals and/or objects may interfere with the opening and/closing of the respective vehicle doors 104*a*-104*e* and may constitute as a hazard with respect to automatically opening and/or closing of the respective vehicle doors 104*a*-104*e*. For example, the door area zones 134*a*-134*e* may include a maximum amount of space utilized when the vehicle door(s) 104*a*-104*e* are being swung opened or swung closed.

With reference to FIG. 2, in an exemplary embodiment, the portable device 126 may include, but are not limited to, one or more of electronic key fobs, smart keys, mobile electronic devices, remote controls, and the like. Several functions of the vehicle 102 may be controlled by user input that is provided on the one or more portable devices 126 that influence and/or command the ECU 110 and/or the hands free door application 108 to control the components of the system 100 based on wireless computer communication between the portable device 126 and the transceiver(s) 118*a*-118*h* of the vehicle 102.

In one embodiment, the microprocessor 202 of the portable device 126 is utilized to operably control components of the portable device 126 and to execute the hands free door application 108. The microprocessor 202 may include memory, an interface circuit, and bus lines, for transferring data, sending commands, communicating with the various components and controlling an overall operation of the portable device 126. In one embodiment, the microprocessor 202 may store a specific identification code that specifically corresponds to the portable device 126 to be used as an identification mechanism by the vehicle 102. The identification code may be inputted within the fixed code portion of each RF response message packet created by the application 108 and may be utilized as an identification mechanism by the ECU 110 of the vehicle 102.

The microprocessor 202 may be operably connected to the battery 204 of the portable device 126. The battery 204 may include a lithium battery (e.g., 3 volt lithium battery) that may be utilized to power the components of the portable device 126. As discussed, typically transmitting RF polling response signals in response to each of the continuous polling signals transmitted by the one or more respective transceivers 118*a*-118*h* may consume a large amount of power of the battery 204. For example, a majority of the power consumption of the battery 204 may result based on the transmission by a RF transceiver 210 of RF polling response signals that are transmitted in one-to-one response to each of the continuously received LF polling signals. Therefore, the hands free door application 108 ensures that the aggregation of the data payload portions of the at least two RF polling response signals transmitted by the portable device 126 and the elimination of the duplication (e.g., repetition) of other portions of the at least two RF packets is completed to reduce the overall current consumption on the battery 204 (e.g. by 30%).

The microprocessor 202 may additionally be connected to a storage 206 of the portable device 126. The storage 206 may include various memories such as, for example L1, L2, or L3 cache or system memory. As such, the memory may include static random access memory (SRAM), dynamic RAM (DRAM), flash memory, read only memory (ROM), or other similar memory devices. The storage 206 may be utilized to store one or more operating systems, applications, associated operating system data, application data, and the like that may be executed by the ECU 110. In an exemplary embodiment, the hands free door application 108 may utilize the storage 206 to store one or more RF response message packets that are produced in response to respective received LF polling signals. As discussed below, these RF response message packets may be stored on the storage 206 for evaluation and aggregation with at least one additional RF response message packet that is produced in response to a subsequently respective LF polling signal.

In one embodiment, the portable device 126 may also include a LF transceiver 208 that may be configured to receive the continuous and LF polling signals from the vehicle 102. In particular, the LF transceiver 208 may receive polling signals that are transmitted by the one or more transceivers 118*a*-118*h* within the wide area polling zone 130 and the one or more local area polling zones 132*a*-132*f*. In some embodiments, the LF transceiver 208 may be configured to transmit LF signals to the vehicle 102 and/or other devices outside of the vehicle 102 (e.g., garage door opener).

The portable device 126 may additionally include a RF transceiver 210 that may be configured to transmit the aggregated RF polling response signals to the vehicle 102. For at least every two of the LF polling signals transmitted by the transceiver(s) 118*a*-118*h* of the vehicle 102 and received by the LF transceiver 208, the RF transceiver 210 may transmit a single aggregated RF polling response signals back to the one or more transceivers 118*a*-118*h* of the vehicle 102. In some embodiments, the RF transceiver 210 may also be configured to receive RF signals from the vehicle 102 and/or other devices outside of the vehicle 102 (e.g., garage door opener).

In one or more embodiments, the portable device 106 may include input buttons 212 that may include, but are not limited to, door lock buttons, door unlock buttons, door open/close start/stop button (individual buttons not shown). In one embodiment, the input buttons 212 may additionally include an input button or a toggle switch which may be utilized to disable the energy efficient mode from the default enabled energy efficient mode. The disablement of the energy efficient mode may ensure that the hands free door application 108 discontinues aggregation of every two RF polling response signals created in response to two received LF polling signals. In one embodiment, the input button or toggle switch of the input buttons 212 may also be inputted by the user to re-enable the energy efficient mode of the portable device 126 to again aggregate every two RF polling response signals in response to two received LF polling signals, and again transmit the aggregated RF polling response signals in response to each received LF polling signal.

Figure 3:
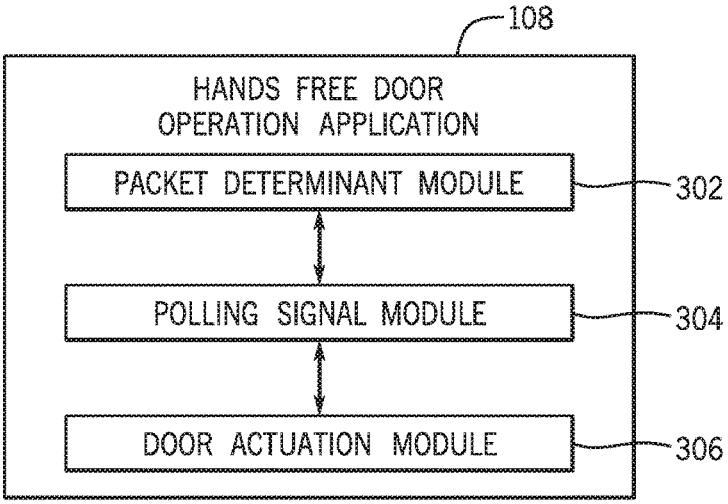
FIG. 3 illustrates a schematic view of an exemplary operating environment of a hands free door application according to an exemplary embodiment of the present disclosure.

The hands free door application 108 will now be discussed in more detail. FIG. 3 illustrates a schematic view of an exemplary operating environment of the hands free door application 108 according to an exemplary embodiment of the present disclosure. As shown in FIG. 3, in an illustrative embodiment, the hands free door application 108 may include one or more modules 302-306 that may include a packet determinant module 302, a polling signal module 304, and a door actuation module 306.

In operation, when the energy efficient mode of the portable device 126 is enabled, the packet determinant module 302 may operate to aggregate two RF polling response signals created to respond to two consecutively received LF polling signals into the (single) aggregated RF response signal. This functionality allows the portable device 126 to respond to the LF polling signals sent by the vehicle 102 at a longer response rate (e.g., 1000 ms between each signal transmission) and thereby conserve power of the battery 204. Alternatively, when the energy efficient mode of the portable device 126 is disabled, the packet determinant module 302 may not operate to aggregate the at least two RF polling response signals.

During disablement of the energy efficient mode, the RF transceiver 210 may accordingly operate to transmit RF polling response signals in response to each of the continuously received LF polling signals. Consequently, the portable device 126 may transmit the RF polling response signals at a shorter response rate (e.g., 500 ms between each signal transmission). For example, during disablement of the energy efficient mode, the portable device 126 may transmit two RF polling response signals for every two LF polling signals received from the vehicle 102, thereby utilizing a higher amount of power of the battery 204 as RF transmission time is not minimized. Alternatively, during enablement of the energy efficient mode, the portable device 126 may transmit one aggregated RF polling response signal for every two LF polling signals received from the vehicle 102, thereby minimizing RF transmission time.

In an exemplary embodiment, during enablement of the energy efficient mode of the portable device 126, the packet determinant module 302 may evaluate each of the continuous LF polling signals transmitted by the transceivers 118*a*-118*g* of the vehicle 102 and received by the LF transceiver 208 of the portable device 126. In particular, upon receipt of each of the LF polling signals by the LF transceiver 208, the LF transceiver 208 may communicate data pertaining to the received LF polling signals to the packet determinant module 302. As discussed in more detail below, the packet determinant module 302 may evaluate the received polling signals and may create respective RF response message packets. Upon creating the respective RF response message packets, the packet determinant module 302 may aggregate two message packets that are created in response to two received LF polling signals into the single aggregated RF response message packet that is contained within the aggregated RF polling response signal transmitted back to the vehicle 102.

Figure 4A:
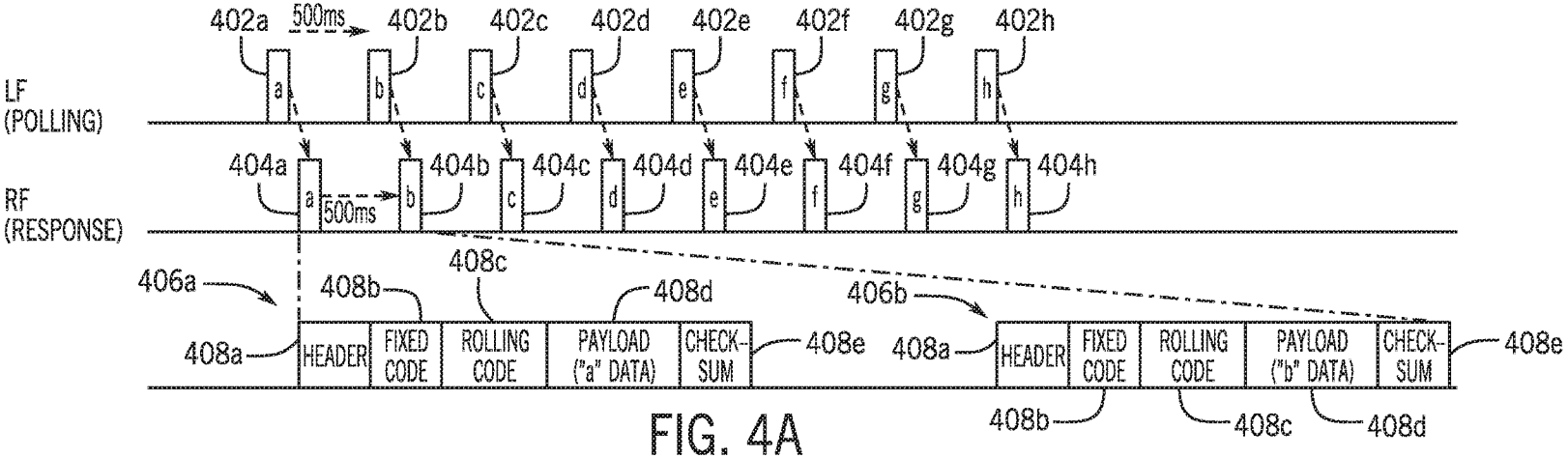
FIG. 4A is an illustrative example of operation of the hands free door application during disablement of an energy efficient mode of the portable device, according to an exemplary embodiment of the present disclosure.

FIG. 4A is an illustrative example of operation of the hands free door application 108 during disablement of the energy efficient mode of the portable device 126, according to an exemplary embodiment of the present disclosure. When the energy efficient mode of the portable device 126 is disabled and the portable device 126 is in a LF signal receiving range of the vehicle 102, the LF transceiver may receive each of the LF polling signals 402*a*-402*h* continuously transmitted by the vehicle 102. In response to receiving each of the LF polling signals 402*a*-402*h*, the packet determinant module 302 may create respective RF response message packets and may utilize the RF transceiver 210 to transmit respective RF polling response signals 404*a*-404*h* that contain the respective RF polling message packets subsequent to receiving each of the respective LF polling signals 402*a*-402*h*. For example, as shown in FIG. 4A, the packet determinant module 302 may create respective RF response message packets 406*a*, 406*b* in response to the reception of the respective LF polling signals 402*a*, 402*b* by the LF transceiver 208. Additionally, during the disablement of the energy efficient mode of the portable device 126, the RF transceiver 210 may be utilized to transmit the respective RF polling response signals 404*a*, 404*b* that include the respective RF response message packets 406*a*, 406*b* to the vehicle 102 as a one-to-one response to each of the respectively received LF polling signals 402*a* and 402*b*.

In an exemplary embodiment, each of the RF response message packets 406*a*, 406*b* contained within each of the respective RF polling response signals 404*a*, 404*b* may individually include the header portion 408*a*, fixed code portion 408*b*, rolling code portion 408*c*, data payload portion 408*d*, and the check-sum portion 408*e*. In one or more embodiments, the header portion 408*a* contained within each RF response message packet 406*a*, 406*b* may include control information that is sent at the start of each message packet 406*a*, 406*b* and may be evaluated by one or more components of the vehicle 102 and the polling signal module 304 of the application 108 upon the receipt of each of the received RF polling response signals 404*a*, 404*b* by one or more of the transceivers 118*a*-118*h*. In one embodiment, the fixed code portion 408*b* may contain the specific identification code that corresponds to the portable device 126 to be used as an identification mechanism by the ECU 110 of the vehicle 102. The identification code may be utilized by the application 108 to ensure that the portable device 126 is (previously) paired with the vehicle 102 prior to providing the hands free door operation. The rolling code portion 408*c* of each of the RF response message packets 406*a*, 406*b* may include an encrypted rolling code that may be utilized by the polling signal module 304 to evaluate a rolling code that is different than a previously sent rolling code. In some embodiments, the rolling code portion 408*c* may be evaluated by application 108 to authenticate the portable device 126 prior to providing the hands free door operation.

In one embodiment, each respective data payload portion 408*d* of the RF response message packets 406*a*, 406*b* may include the actual data that is being transmitted to the vehicle 102. This data may include signal related data that may evaluated by the polling signal module 304 when measuring the RSSI of the aggregated RF polling response signals that are transmitted by the portable device 126. The data included within the data payload portion 408*d* may additionally include data that pertains to the location of the portable device 126 with respect to the vehicle 102 that may include data pertaining to one or more of the transceivers 118*a*-118*h* that the LF polling signals was received from. The data payload portion 408*d* may also include instructions that may be provided as a result of a user input of one or more input buttons 212 and/or by the movement of the portable device 126 as evaluated and determined by the polling signal module 304. In some embodiments, each RF response message packet 406*a*, 406*b* contained within each respective RF polling response signal 404*a*, 404*b* may contain unique data that is based on one or more operations conducted by the user with respect to the input of the input buttons 212 and/or the location and movement of the portable device 126. For example, the data payload portion 408*d* of RF response message packet 406*a* may include data that is unique and different than the data payload portion 408*d* of the RF response message packet 406*b* based on inputs provided by the user or movement of the user while holding the portable device 126 prior to the creation of the respective RF response message packets 406*a*, 406*b*.

In one or more embodiments, the check-sum portion 408*e* of the RF response message packets 406*a*, 406*b* may be utilized as a trailer of the message packet and may include a check-sum. In some additional embodiments, the check-sum portion 408*e* may not be utilized as a trailer and may simply include a check-sum followed by a separate trailer portion (not shown) of each of the RF response message packets 406*a*, 406*b* that contains information to support hands free door operation.

As represented in FIG. 4A, in an exemplary embodiment, when the energy efficient mode of the portable device 126 is disabled, the RF transceiver 210 may transmit the RF polling response signal 404*a* that contains the RF response message packet 406*a* with each of the aforementioned portions 408*a*-408*e* in direct response to the receipt of the LF polling signal 402*a* by the LF transceiver 208. Additionally, upon receipt of the LF polling signal 402*b* (after 500 ms) the RF transceiver 210 may transmit the RF polling response signal 404*b* that contains the RF response message packet 406*b* with each of the aforementioned portions 408*a*-408*e* in direct response to the receipt of the LF polling signal 402*b* by the LF transceiver 208 (500 ms after transmitting the RF polling response signal 404*a*).

As an illustrative example, if each of the continuous LF polling signals 402*a* and 402*b* is received every 500 ms (as represented in FIG. 4A), the RF transceiver 210 is utilized to transmit each of the respective RF polling response signals 404*a* and 404*b* at a response rate of every 500 ms. Consequently, when the energy efficient mode of the portable device 126 is disabled, the battery 204 of the portable device 126 is required to provide a requisite amount of power to support such a transmission time of RF transceiver 210 that may result in the higher battery consumption of the battery 204 as compared to when the portable device 126 is in the energy efficient mode. It is contemplated that the RF transceiver 210 will continue to transmit respective signals with the aforementioned portions of the message packet in direct response to the continually received LF polling signals (e.g., 402*c*-402*h* and beyond) thereby consuming necessary battery power (e.g. every 500 ms) to transmit as many respective RF polling response signals during the predetermined period of time required to actuate powered opening or closing of one or more of the vehicle doors 104*a*-104*e*.

Figure 4B:
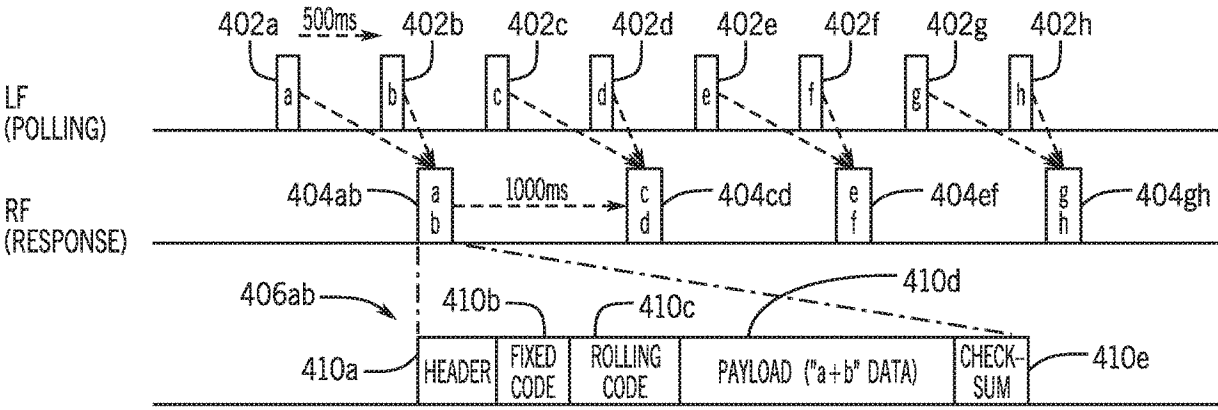
FIG. 4B is an illustrative example of operation of the hands free door application during enablement of the energy efficient mode of the portable device, according to an exemplary embodiment of the present disclosure.

FIG. 4B is an illustrative example of operation of the hands free door application 108 during enablement of the energy efficient mode of the portable device 126, according to an exemplary embodiment of the present disclosure. With reference to FIGS. 4A and 4B, when the energy efficient mode of the portable device 126 is enabled, the RF transceiver 210 may transmit the aggregated RF polling response signal 404*ab* that contains the aggregated RF response message packet 406*ab* that is aggregated from two individual RF response message packets 406*a*, 406*b* that are provided in response to the received LF polling signals 402*a* and 402*b*.

In particular, upon the LF transceiver 208 receiving the LF polling signal 402*a*, the packet determinant module 302 may create the respective RF response message packet 406*a*. Contrary to the operation of the packet determinant module 302 during the disablement of the energy efficient mode, during enablement of the energy efficient mode, instead of utilizing the RF transceiver 210 to transmit a respective RF polling response signal 404*a*, the packet determinant module 302 may store the RF response message packet 406*a* on the storage 206 of the portable device 126. In one embodiment, the RF response message packet 406*a* may be stored on the storage 206 until the subsequent RF response message packet 406*b* is created in response to the subsequently received LF polling signal 402*b*. In other words, the packet determinant module 302 may store the RF response message packet 406*a* to be evaluated for aggregation with the subsequently created RF response message packet 406*b*.

In one embodiment, upon the LF transceiver 208 receiving the LF polling signal 402*b*, the packet determinant module 302 may create the respective RF response message packet 406*b* in response to the subsequently received LF polling signal 402*b* (the second of the pair of LF polling signals 402*a*, 402*b* consecutively transmitted from the vehicle 102). Upon creating the respective RF response message packet 406*b*, the packet determinant module 302 may access the storage 206 and retrieve the stored RF response message packet 406*a*.

In an exemplary embodiment, upon retrieving the RF response message packet 406*a* from the storage 206, the packet determinant module 302 may aggregate the RF response message packet 406*a* and the RF response message packet 406*b* into the aggregated RF response message packet 406*ab*. In an exemplary embodiment, the packet determinant module 302 may evaluate the portions 408*a*-408*e* of the respective RF response message packets 406*a*, 406*b* and may ensure that duplication of the header portion 408*a*, fixed code portion 408*b*, rolling code portion 408*c* and check-sum portion 408*e* does not occur when creating the aggregated RF response message packet 406*ab*.

More specifically, the packet determinant module 302 may create the aggregated RF response message packet 406*ab* that includes the header portion 408*a* from either the RF response message packet 406*a* or the RF response message packet 406*b* since both header portions 408*a* may include matching data. Similarly, the packet determinant module 302 may create the aggregated RF response message packet 406*ab* that includes a fixed code portion 410*b*, a rolling code portion 410*c*, and a check-sum portion 410*e* that includes the respective portions 408*b*, 408*c*, 408*e* from either the RF response message packet 406*a* or the RF response message packet 406*b* since the portions 408*b*, 408*c*, 408*e* of the RF response message packets 406*a*, 406*b* may include matching data. In other words, the packet determinant module 302 does not aggregate duplicate matching data that is found within the header portions 408*a*, fixed code portions 408*b*, rolling code portions 408*c*, and check-sum portions 408*e* of the two RF response message packets 406*a*, 406*b* that are created in response to the LF polling signals 402*a*, 402*b* received by the LF transceiver 208.

In an exemplary embodiment, upon partially creating the aggregated RF response message packet 406*ab* that contains the portions 410*a*, 410*b*, 410*c*, 410*e*, the packet determinant module 302 may aggregate the data payload portions 408*d* of each of the respective RF response message packets 406*a*, 406*b*. In particular, the packet determinant module 302 may extract the data payload portion 408*d* of the RF response message packet 406*a* retrieved from the storage 206 that may contain unique data that is based on one or more operations conducted by the user with respect to the input of the input buttons 212 and/or the location/movement of the portable device 126 (represented in FIG. 4A as including "a" data). The packet determinant module 302 may additionally extract the data payload portion 408*d* of the RF response message packet 406*b* (created in response to the reception of the LF polling signal 402*b* by the LF transceiver 208) that may contain unique data that is based on one or more operations conducted by the user with respect to the input of the input buttons 212 and/or the location/movement of the portable device 126 (represented in FIG. 4A as including "b" data).

In one embodiment, upon extraction of the data payload portions 408*d* from the RF polling signal packets, the packet determinant module 302 may aggregate the data payload portion 408*d* extracted from the RF response message packet 406*a* with the data payload portion 408*d* extracted from the RF response message packet 406*b* to create the aggregated data payload portion 410*d*. The aggregated data payload portion 410*d* may include a combined format of the data contained within both of the data payload portions 408*d* of the RF response message packet 406*a* and RF response message packet 406*b* that may be readable by the polling signal module 304, the door actuation module 306, and/or one or more additional components of the vehicle 102. For example, as shown in FIG. 4B, the aggregated data payload portion 410*d* may include the "a" data extracted from the data payload portion 408*d* of the RF response message packet 406*a* and the "b" data extracted from the data payload portion 408*d* of the RF response message packet 406*b*. In an alternate embodiment, the aggregated data payload portion may include a padding buffer (not shown) that may be included to buffer one portion of the data extracted from the RF response message packet 406*a* from the data extracted from the RF response message packet 406*b*.

In one or more embodiments, upon creating the aggregated data payload portion 410*d*, the packet determinant module 302 may complete the creation of the aggregated RF response message packet 406*ab* that includes the header portion 410*a*, fixed code portion 410*b*, rolling code portion 410*c*, aggregated data payload portion 410*d*, and check-sum portion 410*e*. The packet determinant module 302 may then create the aggregated RF response signal to be transmitted by the RF transceiver 210 to the vehicle 102. More particularly, the packet determinant module 302 may create the aggregated RF response signal that contains the aggregated RF response message packet 406*ab*. In other words, the packet determinant module 302 may ensure that during the energy efficient mode of the portable device 126, the single aggregated RF polling response signal 404*ab* that includes the aggregated RF response message packet 406*ab* is transmitted to the vehicle 102 in contrast to the sending of two separate RF polling response signals 404*a*, 404*b* to respond to the received LF polling signals 402*a*, 402*b*.

As an illustrative example, as represented in FIG. 4B, during the enablement of the energy efficient mode of the portable device 126, the RF transceiver 210 is operably controlled to transmit four aggregated RF polling response signals 404*ab*, 404*cd*, 404*ef*, 404*gh* every 1000 ms rather than transmitting eight RF polling response signals 404*a*-404*h* every 500 ms in response to each received LF polling signals 402*a*-402*h*, as transmitted by the vehicle 102 every 500 ms. Therefore, this functionality results in a reduction of an overall power usage of the battery 204 of the portable device 126.

The polling signal module 304 will now be discussed in more detail with reference to FIG. 1-3. In operation, the polling signal module 304 of the hands free door application 108 may provide command signals to the communication control unit 114 to send signals to the power control unit 112 to supply one or more predetermined amounts of power to the one or more transceivers 118*a*-118*h*. Upon receiving the one or more predetermined amounts of power, the one or more transceivers 118*a*-118*h* may be configured to transmit the continuous LF polling signals to the wide area polling zone 130 and the one or more local area polling zones 132*a*-132*f* to be communicated to the portable device 126.

In one embodiment, when the energy efficient mode of the portable device 126 is enabled, the polling signal module 304 may communicate with the communication control unit 114 to receive data that pertains to the one or more aggregated RF polling response signals that are transmitted by the RF transceiver 210 of the portable device 126. The polling signal module 304 may evaluate the aggregated data payload portion contained within the one or more received aggregated RF polling response signals and may determine RSSI measurements of the one or more aggregated RF polling response signals that are transmitted by the portable device 126.

In an exemplary embodiment, the polling signal module 304 may access and utilize signal strength thresholds that pertain to the one or more aggregated RF polling response signals received by the transceiver(s) 118*a*-118*h*. The signal strength thresholds may be stored on the storage unit 116 and are indicative of the signal strengths of the aggregated RF polling response signals that are transmitted by the portable device 126. In other words, the one or more signal strength thresholds may include values that are indicative of RSSI threshold values that are respectively associated to each of the transceivers 118*a*-118*h* of the vehicle 102. Therefore, each of the transceivers 118*a*-118*h* may be associated with its own set of signal strength thresholds that may be utilized by the polling signal module 304 when it is determined that one or more respective transceivers 118*a*-118*h* has received the aggregated RF polling response signal(s) from the portable device 126. In other words, the signal strength thresholds associated with one of the transceivers 118*a*-118*h* may include unique values (e.g., different values) from signal strength thresholds associated with another of the transceivers 118*a*-118*h*. For example, signal strength thresholds that are associated with the transceiver 118*a* may differ from signal strength thresholds that are associated with the transceiver 118*e*.

In one or more embodiments, the signal strength thresholds may include local area threshold values that are associated with each transceiver 118*a*-118*h*. The local area threshold values may be utilized by the polling signal module 304 to determine an existence of the portable device 126 within or outside of the local area polling zones 132*a*-132*f*. In other words, the local area threshold values may be utilized by the polling signal module 304 to determine if the portable device 126 is within one or more of the local area polling zones 132*a*-132*f* of the vehicle 102.

More specifically, the local area threshold values may provide a minimum signal strength value of the received aggregated RF polling response signals for each of the transceivers 118*a*-118*h*. The local area threshold values may pertain to a respective minimum signal strength that is used to determine that the portable device 126 (and the individual holding the portable device 126) is located within one or more of the local area polling zones 132*a*-132*f* such that if the received signal strength value is below one of the local area threshold values, the portable device 126 may be determined to be in one or more of the respective local area polling zones 132*a*-132*f*.

Conversely, if the received signal strength value is above the local area threshold values, the portable device 126 may be determined to be in the wide area polling zone 130. Therefore, the polling signal module 304 may utilize the local area threshold values to determine the location of the portable device 126 with respect to the vehicle 102 based on a comparison between the received signal strength of one or more received LF polling response signals transmitted by the portable device 126 and the threshold values. The hands free door application 108 may utilize this information to provide one or more amounts of power to unlock/lock one or more of the locks 122*a*-122*e* of the vehicle doors 104*a*-104*e* and/or provide further evaluation as to if one or more of the vehicle doors 104*a*-104*e* should be opened/closed.

In one or more embodiments, the signal strength thresholds may additionally include door area threshold values that are associated with each transceiver 118*a*-118*h*. The door area threshold values may be utilized by the polling signal module 304 to determine an existence of the portable device 126 within or outside of the door area zones 134*a*-134*e* of the local area polling zones 132*a*-132*e*. In other words, the door area threshold values may be utilized by the polling signal module 304 to determine if the portable device 126 is within one or more of the door area zones 134*a*-134*e* of the local area polling zones 132*a*-132*e* to possibly indicate that the portable device 126 is located within the space occupied by the vehicle door(s) 104*a*-104*e* during opening or closing.

In particular, the door area threshold values may provide a minimum signal strength value of the received aggregated RF polling response signal(s) for each of the transceivers 118*a*-118*h*. The door area threshold values may pertain to a respective minimum signal strength that is used to determine that the portable device 126 (and the individual holding the portable device 126) is located within one or more of the door area zones 134*a*-134*e* such that if the received signal strength value is below one of the door area threshold values, the portable device 126 may be determined to be in one or more of the respective door area zones 134*a*-134*e*, within the space occupied by the vehicle door(s) 104*a*-104*e* during opening or closing. Conversely, if the received signal strength value is above the door area threshold values but is below the local area threshold values, the portable device 126 may be determined to be located within one of the respective local area polling zones 132*a*-132*f*, outside of the door area zones 134*a*-134*e*.

In an exemplary embodiment, the signal strength thresholds stored on the storage unit 116 may additionally include one or more signal strength deviation threshold values that may provide a maximum deviation of signal strengths between two or more aggregated RF polling response signals to determine if the portable device 126 is stationary or moving within the one or more local area polling zones 132*a*-132*f*. The polling signal module 304 may analyze signal strengths associated with two or more received aggregated RF polling response signals transmitted by the RF transceiver 210 against the maximum signal strength deviation threshold values associated with one or more of the transceivers 118*a*-118*h* to determine if the portable device 126 is stationary for a predetermined period of time within one of the local area polling zones 132*a*-132*f* and outside of the door area zones 134*a*-134*e* in order to actuate one or more of the motors 106*a*-106*e* to open one or more of the vehicle doors 104*a*-104*e*.

In one or more embodiments, upon receiving the aggregated RF polling response signal(s) from the portable device 126, the communication control unit 114 may analyze data contained within the aggregated data payload portion(s) of the signal(s) and data pertaining to the one or more transceivers 118*a*-118*h* that are receiving the aggregated RF polling response signal(s). The polling signal module 304 may evaluate the data and may determine which of the one or more transceivers 118*a*-118*h* are receiving the aggregated RF polling response signal(s). In one embodiment, the polling signal module 304 may determine which one of the transceivers 118*a*-118*h* are receiving the aggregated RF polling response signal(s) with the highest signal strength and may access the storage unit 116 to retrieve the signal strength thresholds associated with the respective transceiver 118*a*-118*h*.

In circumstances in which the polling signal module 304 determines that more than one of the transceivers 118*a*-118*h* is receiving the aggregated RF polling response signal(s) with the highest signal strength (e.g., more than one transceiver 118*a*-118*h* received the aggregated RF polling response signal within a predetermined signal strength range), the polling signal module 304 may access the storage unit 116 to retrieve the signal strength thresholds associated with the respective transceivers 118*a*-118*h*.

In an exemplary embodiment, the polling signal module 304 may compare the signal strength of the aggregated RF polling response signal(s) against the signal strength thresholds associated with the respective transceiver(s) 118*a*-118*h* as stored on the storage unit 116 to determine the location and/or movement of the portable device 126 with respect to the vehicle 102. In particular, as described below, the polling signal module 304 may utilize the local area threshold value(s) associated with each of the one or more transceivers 118*a*-118*h* to determine if the portable device 126 may be located within one or more of the local area polling zones 132*a*-132*d* or the wide area polling zone 130.

The polling signal module 304 may additionally utilize the door area threshold value(s) associated with each one of the transceivers 118*a*-118*h* to determine if the portable device 126 may be located within one or more of the door area zones 134*a*-134*e*. If it is determined that the portable device 126 is located within one or more of the local area polling zones 132*a*-132*d* but not within the one or more door area zones 134*a*-134*e*, the polling signal module 304 may utilize the one or more signal strength deviation threshold values associated with one or more of the transceivers 118*a*-118*h* to determine if the portable device 126 is or is not stationary for a predetermined period of time.

The predetermined period of time utilized by the polling signal module 304 may be a period of time that is deemed to be appropriate for the individual carrying the portable device 126 to be stationary within the one or more of the local zones 132*a*-132*h* for the hands free door application 108 to safely actuate powered opening/closing of one or more vehicle doors 104*a*-104*e*. The powered opening/closing of the one or more vehicle doors 104*a*-104*e* may be individually actuated based on the determination of the location of the portable device 126 within one or more of the local area polling zones 132*a*-132*f* that are in closest proximity to the one or more respective vehicle doors 104*a*-104*e*.

In an exemplary embodiment, the polling signal module 304 may execute a timer that is utilized to determine if the predetermined period of time has expired to determine if the portable device 126 remains stationary for the predetermined period of time. The timer may actuate a countdown sequence that may include a total time that is representative of the amount of time that is deemed to be appropriate for the individual carrying the portable device 126 to be stationary within the one or more of the local zones 132*a*-132*h* (outside of the one or more door area zones 134*a*-134*e*) in order for the hands free door application 108 to safely actuate powered opening of one or more vehicle doors 104*a*-104*e* determined to be located in closest proximity to the portable device 126.

In some embodiments, the polling signal module 304 may interpret the one or more aggregated RF polling response signals received by the transceiver(s) 118*a*-118*h* from the one or more portable devices 126 in the manner discussed above to possibly unlock the lock(s) 122*a*-122*e* and/or to open one or more of the vehicle doors 104*a*-104*e*. Similarly, the polling signal module 304 may interpret the one or more LF polling response signals to determine the location and movement of the portable device 126 with respect to the vehicle 102 to possibly lock the lock(s) 122*a*-122*e* and/or to close one or more of the vehicle doors 104*a*-104*e* after being unlocked and opened.

In one embodiment, upon determining the location and the movement of the portable device 126 with respect to the vehicle 102, the polling signal module 304 may send one or more data signals to the door actuation module 306 of the hands free door application 108. The door actuation module 306 may provide one or more commands to the power control unit 112 of the vehicle 102 to supply one or more requisite amounts of power to one or more of the motors 106*a*-106*e* to lock and unlock one or more of the door locks 122*a*-122*e* of associated vehicle doors 104*a*-104*e*. Additionally, the door actuation module 306 may provide one or more commands to the power control unit 112 of the vehicle 102 to supply one or more requisite amounts of power to one or more of the motors 106*a*-106*e* to open and/or close one or more of the associated vehicle doors 104*a*-104*e*.

Exemplary Methods Utilized by Hands Free Door Operation Application

Figure 5:
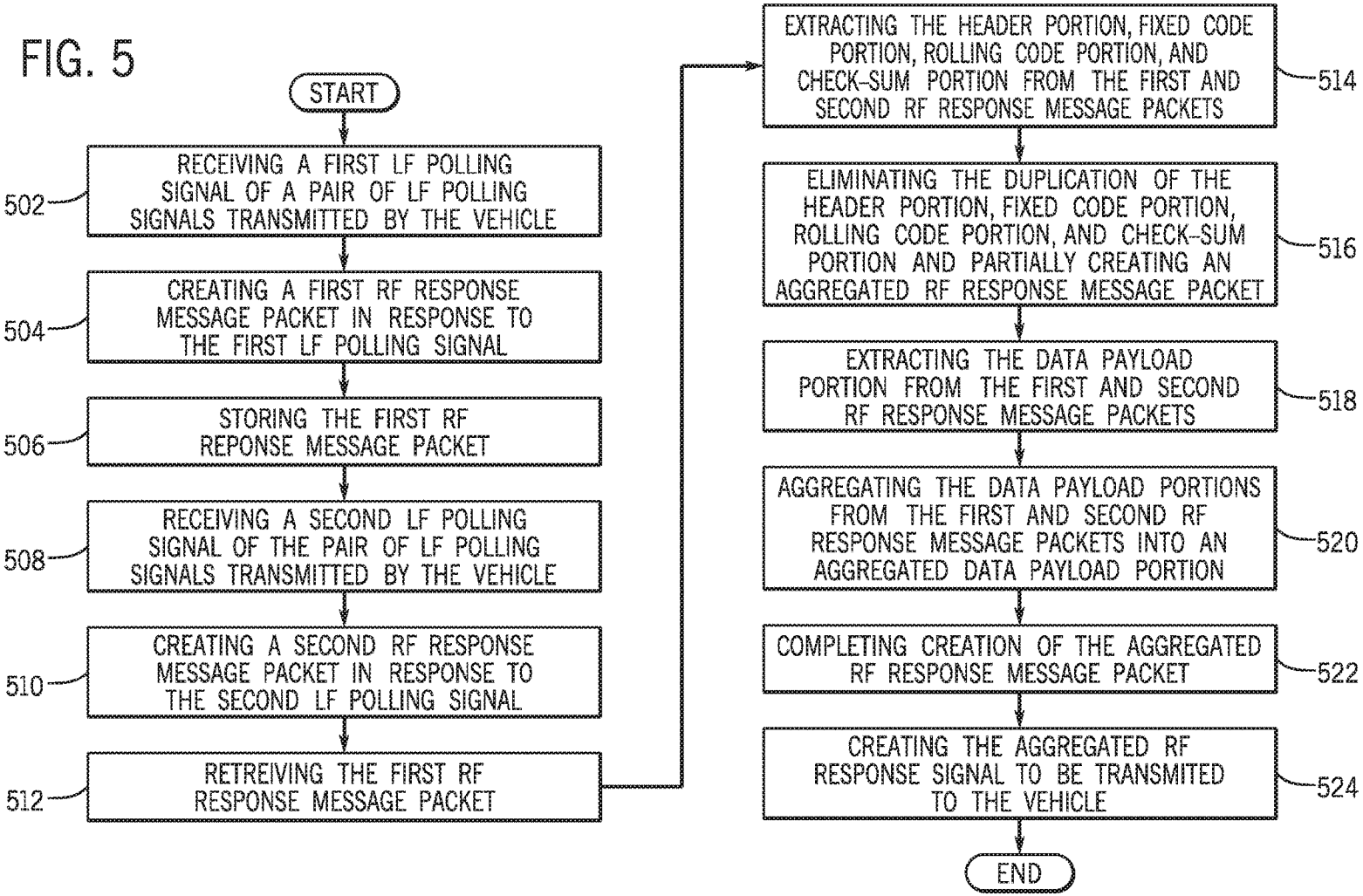
FIG. 5 is a process flow diagram of a method for creating an aggregated RF polling response signal during enablement of the energy efficient mode of the portable device according to an exemplary embodiment of the present disclosure.

FIG. 5 is a process flow diagram of a method for creating the aggregated RF polling response signal during enablement of the energy efficient mode of the portable device 126 according to an exemplary embodiment of the present disclosure. FIG. 5 will be described with reference to the components of FIGS. 1-3 though it is to be appreciated that the method of FIG. 5 may be used with other systems and/or components. The method 500 may begin at block 502, wherein the method may include receiving a first LF polling signal of a pair of LF polling signals transmitted by the vehicle 102. In an exemplary embodiment, the ECU 110 may determine if the vehicle 102 is parked and the vehicle door(s) 104*a*-104*e* is in a closed position based on signals sent from one or vehicle door lock sensors (not shown). Upon this determination, the ECU 110 may send a signal(s) to the polling signal module 304 of the hands free door application 108 to initiate a portable device polling mode.

In one embodiment, during the portable device polling mode, the polling signal module 304 may send a command signal(s) to the communication control unit 114 to initiate transmission of continuous low power or high power LF polling signals by the transceiver(s) 118*a*-118*h*. The communication control unit 114 may be configured to control the transceiver(s) 118*a*-118*h* to continually transmit the low power or high power LF polling signals at a predetermined frequency (e.g., every 500 ms) to determine if the portable device 126 is located within the wide area polling zone 130 or one of the local area polling zones 132*a*-132*f*. Consequently, the LF transceiver 208 may receive the first LF polling signal transmitted by the transceiver(s) 118*a*-118*h* of each pair of LF polling signals transmitted by the transceiver(s) 118*a*-118*h* during the portable device polling mode.

The method 500 may proceed to block 504, wherein the method 500 may include creating a first RF response message packet in response to the first LF polling signal. In an exemplary embodiment, upon receiving the first LF polling signal of the pair of LF polling signals, the LF transceiver 208 may communicate respective data to the packet determinant module 302. The packet determinant module 302 may evaluate the first LF polling signal and may create the first RF response message packet. As discussed above (with respect to FIGS. 4A and 4B), in an exemplary embodiment, the first RF response message packet may be created with a header portion, a fixed code portion, a rolling code portion, a data payload portion, and a check-sum portion.

The method 500 may proceed to block 506, wherein the method 500 may include storing the first RF response message packet. In one embodiment, upon creation of the first RF response message packet in response to the received first LF polling signal, the packet determinant module 302 may store the first RF response message packet within the storage 206 of the portable device 126. As discussed below, the first RF response message packet may be stored on the storage 206 until the subsequent second RF response message packet 406*b* is created in response to a subsequently received second LF polling signal.

The method 500 may proceed to block 508, wherein the method 500 may include receiving a second LF polling signal of the pair of LF polling signals transmitted by the vehicle 102. In an exemplary embodiment, during the portable device polling mode, the communication control unit 114 may be configured to control the transceiver(s) 118*a*-118*h* to continue to transmit the low power or high power LF polling signals at the predetermined frequency (e.g., every 500 ms) to determine if the portable device 126 is located within the wide area polling zone 130 or one of the local area polling zones 132*a*-132*f*. Consequently, the LF transceiver 208 may receive the second LF polling signal transmitted by the transceiver(s) 118*a*-118*h* of each pair of LF polling signals transmitted by the transceiver(s) 118*a*-118*h* during the portable device polling mode.

The method 500 may proceed to block 510, wherein the method 500 may include creating a second RF response message packet in response to the second LF polling signal. In an exemplary embodiment, upon receiving the second LF polling signal of the pair of LF polling signals, the LF transceiver 208 may communicate respective data to the packet determinant module 302. The packet determinant module 302 may evaluate the second LF polling signal and may create the second RF response message packet. As discussed above (with respect to FIGS. 4A and 4B), in an exemplary embodiment, the second RF response message packet may be created with a header portion, a fixed code portion, a rolling code portion, a data payload portion, and a check-sum portion.

The method 500 may proceed to block 512, wherein the method 500 may include retrieving the first RF response message packet. In one or more embodiments, upon receiving the second LF polling signal of the pair of LF polling signals transmitted by the vehicle 102, the packet determinant module 302 may access the storage 206 of the portable device 126 and may retrieve the first RF response message packet previously stored by the module 302 (at block 506).

The method 500 may proceed to block 514, wherein the method 500 may include extracting the header portion, fixed code portion, rolling code portion, and check-sum portion from the first and second RF response message packets. In an exemplary embodiment, upon creating the second RF response message packet and retrieving the first RF response message from the storage 206, the packet determinant module 302 may extract the header portion, fixed code portion, rolling code portion, and check-sum portion respectively from the first RF response message packet created in response to the received first LF polling signal and the second RF response message packet created in response to the received second LF polling signal.

The method 500 may proceed to block 516, wherein the method 500 may include eliminating the duplication of the header portion, fixed code portion, rolling code portion, and check-sum portion and partially creating an aggregated RF response message packet. In one or more embodiments, upon extracting the header, fixed code, rolling code, and check-sum portions of the first and second RF response message packets, the packet determinant module 302 may evaluate the portions and may ensure that duplication of the packets does not occur when creating the aggregated RF response message packet that is created in response to the received pair of (first and second) LF polling signals.

In an exemplary embodiment, the packet determinant module 302 may partially create the aggregated RF response message packet that includes the header portion, fixed code portion, rolling code portion, and check-sum portion from either the first RF response message packet or the second RF response message packet. In some embodiments, the packet determinant module 302 may partially create the aggregated RF response message packet from the second RF response packet and may discard the aforementioned portions of the first RF response packet prior to storing the first RF response packet on the storage 206 or upon retrieving the first RF response packet from the storage 206. In alternate embodiments, the packet determinant module 302 may partially create the aggregated RF response message packet from the first RF response packet and may discard the aforementioned portions of the second RF response packet upon creating the second RF response packet. In additional embodiments, the packet determinant module 302 may create the second RF response message packet without the header portion, fixed code portion, rolling code portion, and check-sum portion and may only utilize the aforementioned portions of the first RF response message upon partially creating the aggregated RF response message packet.

The method 500 may proceed to block 518, wherein the method 500 may include extracting the data payload portion from the first and second RF response message packets. In an exemplary embodiment, upon partially creating the RF response message packet (at block 516), the packet determinant module 302 may extract the data payload portion from the first RF response message and the data payload portion from the second RF response message. As discussed, each of the respective data payload portions may contain unique data that is based on one or more operations conducted by the user with respect to the input of the input buttons 212 and/or the movement of the portable device 126.

The method 500 may proceed to block 520, wherein the method 500 may include aggregating the data payload portions from the first and second RF response message packets into an aggregated data payload portion. In an exemplary embodiment, the packet determinant module 302 may aggregate the data payload portion extracted from the first RF response message packet with the data payload portion extracted from the second RF response message packet to create the aggregated data payload packet. The aggregated data payload packet may include a combined format of the data contained within both of the first and second data payload portions of the respective first and second RF response message packets that may be readable by the polling signal module 304, the door actuation module 306, and/or one or more components of the vehicle 102.

The method 500 may proceed to block 522, wherein the method 500 may include completing creation of the RF response message packet. In one embodiment, upon creating the aggregated data payload packet, the packet determinant module 302 may complete the creation of the aggregated RF response message packet that includes the header code portion, the fixed code portion, the rolling code portion, the aggregated data payload portion, and the check-sum portion (e.g., similar to the aggregated RF response message packet 406*ab* shown in FIG. 4B). In particular, the packet determinant module 302 may ensure that the aggregated data payload portion is added to the partially created RF response message in a specific area/part of the packet (e.g., after the rolling code portion and before the check-sum portion) in order to be readable by the polling signal module 304 and/or one or more components of the vehicle 102.

The method 500 may proceed to block 524, wherein the method 500 may include creating the aggregated RF response signal to be transmitted to the vehicle 102. In an exemplary embodiment, the packet determinant module 302 may create the aggregated RF response signal to be provided in a transmittable format that may be efficiently transmitted by the RF transceiver 210 while utilizing a low amount of battery power. The packet determinant module 302 may create the aggregated RF response signal to contain the aggregated response message. As discussed below in more detail, at least one aggregated RF response signal may be transmitted by the portable device 126 to the vehicle 102 in response to the reception of at least one pair of LF polling signals transmitted by the vehicle 102 during the portable device polling mode to provide hands free operation of at least one vehicle door 104*a*-104*e*.

Figure 6A:
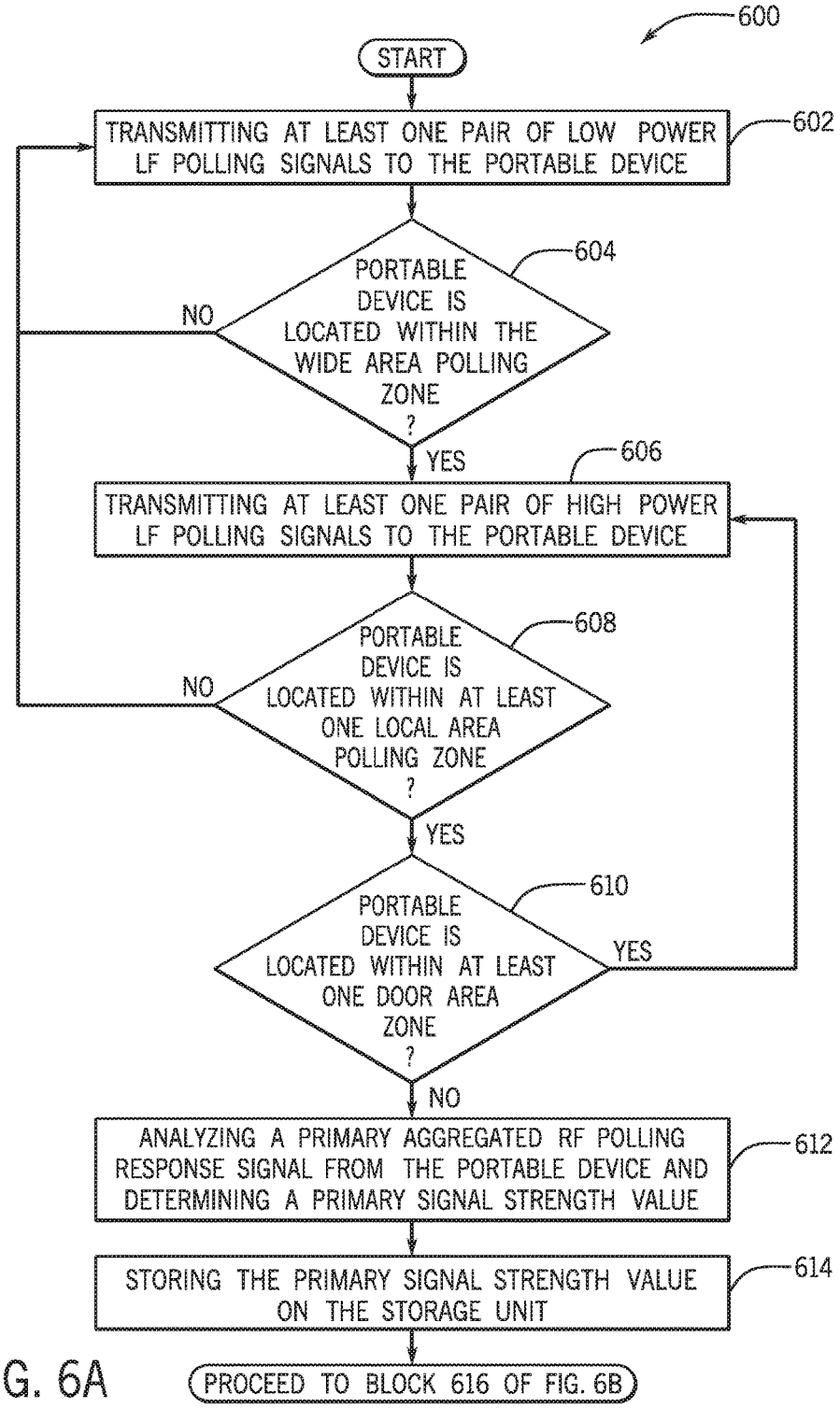
FIG. 6A is a process flow diagram of a first part of a method for providing hands free powered opening of at least one vehicle door during enablement of the energy efficient mode of the portable device according to an exemplary embodiment of the present disclosure.

FIG. 6A is a process flow diagram of a first part of a method 600 for providing hands free powered opening of at least one vehicle door 104*a*-104*e* during enablement of the energy efficient mode of the portable device 126 according to an exemplary embodiment of the present disclosure. As described below, the method 600 will be discussed in two parts with respect to FIG. 6A and FIG. 6B. The method 600 may begin at block 602, wherein the method 600 may include transmitting at least one pair of low power LF polling signals to the portable device 126.

In one embodiment, during the portable device polling mode, the polling signal module 304 may send a command signal(s) to the communication control unit 114 to initiate transmission of a first low power LF polling signal and a second low power LF polling signal by the transceiver(s) 118*a*-118*h*. Upon receipt of the command signal(s), the communication control unit 114 may utilize the transceiver(s) 118*a*-118*h* to transmit the first low power LF polling signal and the second low power LF polling signal as at least one pair of low power LF polling signals that reach a predetermined distance within the wide area polling zone 130. The communication control unit 114 may be configured to control the transceiver(s) 118*a*-118*h* to transmit a predetermined number of pairs of LF low power polling signals within a predetermined time period. In some embodiments, the communication control unit 114 may be configured to control the transceiver(s) 118*a*-118*h* to transmit the at least one pair of low power LF polling signals at a predetermined frequency (e.g., every 500 ms) to determine if the portable device 126 is located within the wide area polling zone 130.

The method 600 may proceed to block 604, wherein the method 600 may include determining if the portable device 126 is located within the wide area polling zone 130. In an exemplary embodiment, if the portable device 126 (e.g., the individuals(s) carrying the portable device 126) is located within the wide area polling zone 130, the LF transceiver 208 of the portable device 126 may receive the at least one pair of low power LF polling signals transmitted by the transceivers 118*a*-118*h* of the vehicle 102. Upon receiving the pair of low power LF polling signals, the LF transceiver 208 may communicate respective data to the packet determinant module 302. As discussed above with respect to FIG. 5, the packet determinant module 302 may create the aggregated RF polling response signal that contains the aggregated RF response message packet in response to the pair of low power LF polling signals received by the LF transceiver 208.

In one embodiment, the microprocessor 202 of the portable device 126 may instruct the RF transceiver 210 of the portable device 126 to transmit the aggregated RF polling response signal to the vehicle 102. Upon receipt of the aggregated RF polling response signal by one or more of the transceivers 118*a*-118*h*, the communication control unit 114 may analyze data received by the signals and data pertaining to the one or more transceivers 118*a*-118*h* received by the aggregated RF polling response signal as contained within an aggregated payload portion of the signal. The communication control unit 114 may further communicate the data from the aggregated RF polling response signal to the polling signal module 304.

Upon receipt of the aggregated RF polling response signal, the polling signal module 304 may evaluate the data that pertains to the location of the portable device 126 contained within the aggregated data payload portion and may determine the signal strength of the aggregated RF polling response signal. Additionally, the polling signal module 304 may evaluate the data from the aggregated payload portion of the aggregated RF polling response signal and may determine the one or more transceivers 118*a*-118*h* of the vehicle 102 that received the pair of LF polling response signals transmitted by the portable device 126. The polling signal module 304 may determine which one of the transceivers 118*a*-118*h* received the aggregated RF polling response signal with the highest signal strength and may access the storage unit 116 to retrieve the signal strength thresholds associated with the respective transceiver 118*a*-118*h*.

In an exemplary embodiment, the polling signal module 304 may compare the determined signal strengths of the aggregated RF response signal received by the transceiver(s) 118*a*-118*h* against the signal strength thresholds associated with the respective transceiver(s) 118*a*-118*h* as stored on the storage unit 116. In particular, the polling signal module 304 may compare the determined signal strength of the aggregated RF response signal against the local area threshold value(s) associated with the one or more transceivers 118*a*-118*h* which are determined to have received the aggregated RF response signal with the highest signal strength to determine if the portable device 126 may be located within the wide area polling zone 130. If the polling signal module 304 determines that the determined signal strength of the aggregated RF response signal is above the local area threshold value(s) associated with the one or more transceivers 118*a*-118*h* which are determined to have received the aggregated RF response signal with the highest signal strength, the polling signal module 304 may determine that the portable device 126 is located within the wide area polling zone 130.

If it is determined that the portable device 126 is located within the wide area polling zone 130 (at block 604), the method 600 may proceed to block 606, wherein the method 600 may include transmitting at least one pair of high power LF polling signals to the portable device 126. In one embodiment, during the portable device polling mode, the polling signal module 304 may send a command signal(s) to the communication control unit 114 to initiate transmission of a first high power LF polling signal and a second high power LF polling signal by the transceiver(s) 118*a*-118*h*. Upon receipt of the command signal(s), the communication control unit 114 may utilize the transceiver(s) 118*a*-118*h* to transmit the pair of first and second high power LF polling signals that reach the entirety of each of the local area polling zones 132*a*-132*f*. The communication control unit 114 may be configured to control the transceiver(s) 118*a*-118*h* to transmit a predetermined number of pairs of high power LF polling signals within a predetermined time period. In one embodiment, the communication control unit 114 may be configured to control the transceiver(s) 118*a*-118*h* to transmit the pair of high power LF polling signals at a predetermined frequency (e.g., once per every 300 ms) to determine if the portable device 126 is located within at least one of the local area polling zone(s) 132*a*-132*f*.

With continued reference to FIG. 6A, the method 600 may proceed to block 608, wherein the method 600 may include determining if the portable device 126 is located within at least one local area polling zone 132*a*-132*f*. In an exemplary embodiment, if the portable device 126 (and the individual carrying the portable device 126) is located within one or more of the local area polling zones 132*a*-132*f*, the LF transceiver 208 of the portable device 126 may receive the pair of high power LF polling signals transmitted by the transceivers 118*a*-118*h* of the vehicle 102. As discussed above, upon receiving the pair of high power LF polling signals, the LF transceiver 208 may communicate respective data to the packet determinant module 302. As discussed above with respect to FIG. 5, the packet determinant module 302 may create the aggregated RF polling response signal that contains the aggregated RF response message packet in response to the pair of high power LF polling signals received by the LF transceiver 208.

In one embodiment, the microprocessor 202 of the portable device 126 may instruct the RF transceiver 210 to transmit the aggregated RF polling response signal within a predetermined frequency (e.g., once per every 600 ms in response to the each of the pair of LF polling signals received every 300 ms). Upon receipt of the aggregated RF polling response signal by one or more of the transceivers 118*a*-118*h*, the communication control unit 114 may analyze data pertaining to the one or more transceivers 118*a*-118*h* and additional data contained within the aggregated payload portion of the aggregated RF polling response signal and may communicate respective data to the polling signal module 304.

The polling signal module 304 may evaluate the data and may determine the signal strength of the aggregated RF polling response signal received from the portable device 126. Additionally, the polling signal module 304 may evaluate the data that pertains to the location of the portable device 126 contained within the aggregated data payload portion of the aggregated RF polling response signal and may determine the one or more transceivers 118*a*-118*h* of the vehicle 102 that received the aggregated RF polling response signal transmitted by the portable device 126. In one embodiment, the polling signal module 304 may determine which one of the transceivers 118*a*-118*h* received the aggregated RF polling response signal with the highest signal strength and may access the storage unit 116 to retrieve the signal strength thresholds associated with the respective transceiver 118*a*-118*h*.

In an exemplary embodiment, the polling signal module 304 may compare the determined signal strength of the aggregated RF polling response signal received by the transceiver(s) 118*a*-118*h* against the signal strength thresholds associated with the respective transceiver(s) 118*a*-118*h* as stored on the storage unit 116. In particular, the polling signal module 304 may compare the determined signal strength of the aggregated RF polling response signal against the local area threshold value(s) associated with the one or more transceivers 118*a*-118*h* which are determined to have received the aggregated RF polling response signal with the highest signal strength to determine if the portable device 126 may be located within at least one of the local area polling zones 132*a*-132*f*.

More specifically, if the polling signal module 304 determines that the determined signal strength of the aggregated RF polling response signal is below the local area threshold value(s) associated with one or more of the transceivers 118*a*-118*h* which are determined to have received the aggregated RF polling response signal with the highest signal strength, the polling signal module 304 may then determine that the portable device 126 is located within the respective local area polling zone(s) 132*a*-132*f*. The respective local area polling zone(s) 132*a*-132*f* may be located at a close proximity to the one or more transceivers 118*a*-118*h* which are determined to have received the aggregated RF polling response signal with the highest signal strength. In one embodiment, the polling signal module 304 may be able to determine a location of the portable device 126 within the local area polling zone(s) 132*a*-132*f* by determining and evaluating a difference between the signal strength of the aggregated RF polling response signal and the local area threshold value(s) associated with the one or more transceivers 118*a*-118*h* which are determined to have received the aggregated RF polling response signal with the highest signal strength.

As an illustrative example, if the transceiver 118*e* is determined to receive the aggregated RF polling response signal with the highest signal strength from the portable device 126, the polling signal module 304 may compare the signal strength of the aggregated RF polling response signal received against the local area threshold value associated with the transceiver 118*e*. If the signal strength of the aggregated RF polling response signal is below the local area threshold value, the polling signal module 304 may determine that the portable device 126 is located within the local area polling zone 132*e* which is in closest proximity to the transceiver 118*e* and the tailgate door 104*e*. The polling signal module 304 may additionally determine the difference between the signal strength of the aggregated RF polling response signal and the local area threshold value associated with the transceiver 118*e* and may further determine the location of the portable device 126 within the local area polling zone 132*e*.

In one or more embodiments, if it is determined that the portable device 126 is located within a particular local area zone(s) based on the evaluation of the signal strength of the aggregated RF polling response signal, the polling signal module 304 may send signal(s) to the door actuation module 306 that may indicate the local area polling zone(s) 132*a*-132*f* in which the portable device 126 is determined to be located. Upon receipt of the signal(s), the door actuation module 306 may send a command signal(s) to the power control unit 112 to supply a predetermined amount of power to the motor(s) 106*a*-106*e* associated with the vehicle door(s) 104*a*-104*e* that is located in close proximity to the local area polling zone(s) 132*a*-132*f* to unlock the lock(s) 122*a*-122*e* of the respective vehicle door(s) 104*a*-104*e*.

In one embodiment, when the portable device 126 is located within one of the respective local area polling zones 132*a*-132*f*, the door actuation module 306 may send the command signal(s) to the power control unit 112 to supply the predetermined amount of power to the one or more motors 106*a*-106*d*. In particular, the command signal(s) may be sent to the one or more motors 106*a*-106*d* associated with the one or more respective vehicle doors 104*a*-104*d* that are located at the front portion 128*a* and/or the middle portion 128*b* of the vehicle 102 to unlock the lock(s) 122*a*-122*d* of the respective vehicle door(s) 104*a*-104*d*. When the portable device 126 is located within the polling zone 132*e*, the door actuation module 306 may send the command signal(s) to the power control unit 112 to supply the predetermined amount of power to the motor 106*e* to unlock the lock 122*e* of the tailgate door 104*e*.

In an additional embodiment, upon receipt of the signal(s), the door actuation module 306 may determine the portion of the vehicle 102 that is in closest proximity to the local area polling zone(s) 132*a*-132*f* in which the portable device 126 is determined to be located. The door actuation module 306 may send a command signal(s) to the power control unit 112 to supply a predetermined amount of power to the motor(s) 106*a*-106*e* associated with the vehicle door(s) 104*a*-104*e* that is determined to be located at the portion of the vehicle 102 that is in closest proximity to the local area polling zone(s) 132*a*-132*f* to unlock the lock(s) 122*a*-122*e* of the respective vehicle door(s) 104*a*-104*e*.

With continued reference to the method 600 of FIG. 6A, if it is determined that the portable device 126 is located within at least one local area polling zone 132*a*-132*f* (at block 608), the method 600 may proceed to block 610, wherein the method 600 may include determining if the portable device 126 is located within at least one door area zone 134*a*-134*e*. In an exemplary embodiment, upon the determining the local area polling zone(s) 132*a*-132*f* that the portable device 126(*a*) is located within (at block 608), the polling signal module 304 will determine if the portable device 126 is located within at least one door area zone 134*a*-134*e*. In other words, if it is determined (at block 608) that the portable device 126 is located within the local area polling zone 132*f* (that does not directly include any of the vehicle doors 104*a*-104*e*), the polling signal module 304 may determine that the portable device 126 is not located within at least one door area zone.

In one embodiment, if is determined that the portable device 126 is located within at least one of the local area polling zones 132*a*-132*e*, the polling signal module 304 may further evaluate the aggregated payload portion of the aggregated RF polling response signal to determine if the portable device 126 is located within one or more of the door area zones 134*a*-134*e*. In an exemplary embodiment, the polling signal module 304 may compare the determined signal strength of the aggregated RF polling response signal against the door area threshold value(s) associated with the one or more transceivers 118*a*-118*h* that are in closest proximity to the local area polling zone(s) 132*a*-132*e* in which the portable device 126 is located. This comparison is conducted to determine if the portable device 126 may be located within at least one of the door area zones 134*a*-134*e* of the local area polling zone(s) 132*a*-132*e*.

More specifically, if the polling signal module 304 determines that the determined signal strength of the aggregated RF polling response signal is below the door area threshold value(s) associated with one or more of the respective transceivers 118*a*-118*h*, the polling signal module 304 may consequently determine that the portable device 126 is located within the respective door area zone(s) 134*a*-134*e*. In one embodiment, the polling signal module 304 may be able to determine a specific location of the portable device 126 within the door area zone(s) 134*a*-134*e* by determining and evaluating a difference between the signal strength of the aggregated RF polling response signal and the door area threshold value(s) associated with the one or more transceivers 118*a*-118*h* that are in closest proximity to the local area polling zone(s) 132*a*-132*f* in which the portable device 126 is determined to be located.

If it is determined that the portable device 126 is located within at least one door area zone (at block 610), the method 600 may revert back to block 606, wherein the method 600 may include transmitting at least one pair of high power LF polling signals to the portable device 126. If it is determined that the portable device 126 is not located within at least one door area zone (at block 610), the method 600 may proceed to block 612, wherein the method 600 may include analyzing a primary aggregated RF polling response signal from the portable device 126 and determining a primary signal strength value.

In an exemplary embodiment, upon determining that the portable device 126 is located within the at least one local are polling zone 132*a*-132*f* (at block 608) and determining that the portable device 126 is not located within at least one door area zone 134*a*-134*e* (at block 610), the polling signal module 304 may send a command signal(s) to the communication control unit 114 to reinitiate transmission of one or more pairs of high power LF polling signals by the transceiver(s) 118*a*-118*h*. Upon receipt of the command signal(s), the communication control unit 114 may utilize the transceiver(s) 118*a*-118*h* that are near to the local area polling zone(s) 132*a*-132*e* in which the portable device 126 is determined to be located to transmit the first high power LF polling signal and a second high power LF polling signal as a pair of one or more pairs of high power LF polling signals. The pair(s) of high power LF polling signals may reach the entirety of respective local area polling zone(s) 132*a*-132*f* in which the portable device 126 is determined to be located.

Upon the portable device 126 receiving at least one pair of high power LF polling signals, and upon the creation of the aggregated RF response signal in response to the received pair of LF polling signals by the packet determinant module 302, as described above, the RF transceiver 210 of the portable device 126 may send the aggregated RF polling response signal to the transceiver(s) 118*a*-118*h*. The communication control unit 114 may communicate data contained within the aggregated data payload portion of the aggregated RF polling response signal as received from the transceiver(s) 118*a*-118*h* of the vehicle 102 that are in closest proximity to the local area polling zone(s) 132*a*-132*f* in which the portable device 126 is determined to be located to the polling signal module 304. Upon receiving the data contained within the aggregated data payload portion of the aggregated RF polling response signal, the polling signal module 304 may identify the aggregated RF polling response signal as a primary aggregated RF polling response signal.

In one embodiment, the polling signal module 304 may analyze the primary aggregated RF polling response signal and may determine the signal strength of the aggregated RF polling response signal based on the aggregated RF polling response signal received by the transceiver(s) 118*a*-118*h* of the vehicle 102 that are in closest proximity to the local area polling zone(s) 132*a*-132*f* in which the portable device 126 is determined to be located. Upon determining the signal strength of the primary aggregated RF polling response signal, the polling signal module 304 may determine a primary signal strength value that is indicative of the signal strength of the primary aggregated RF polling response signal.

The method 600 may proceed to block 614, wherein the method 600 may include storing the primary signal strength value on the storage unit 116. In one or more embodiments, upon determining the primary signal strength value, the polling signal module 304 may access the storage unit 116 and may store the primary signal strength value on the storage unit 116. In some embodiments, the primary signal strength value may be accessible to the polling signal module 304 until the portable device 126 is determined to no longer be located within the respective local area polling zone(s) 132*a*-132*f* or vehicle door(s) 104*a*-104*e* is opened (e.g., manually opened by the individual).

Figure 6B:
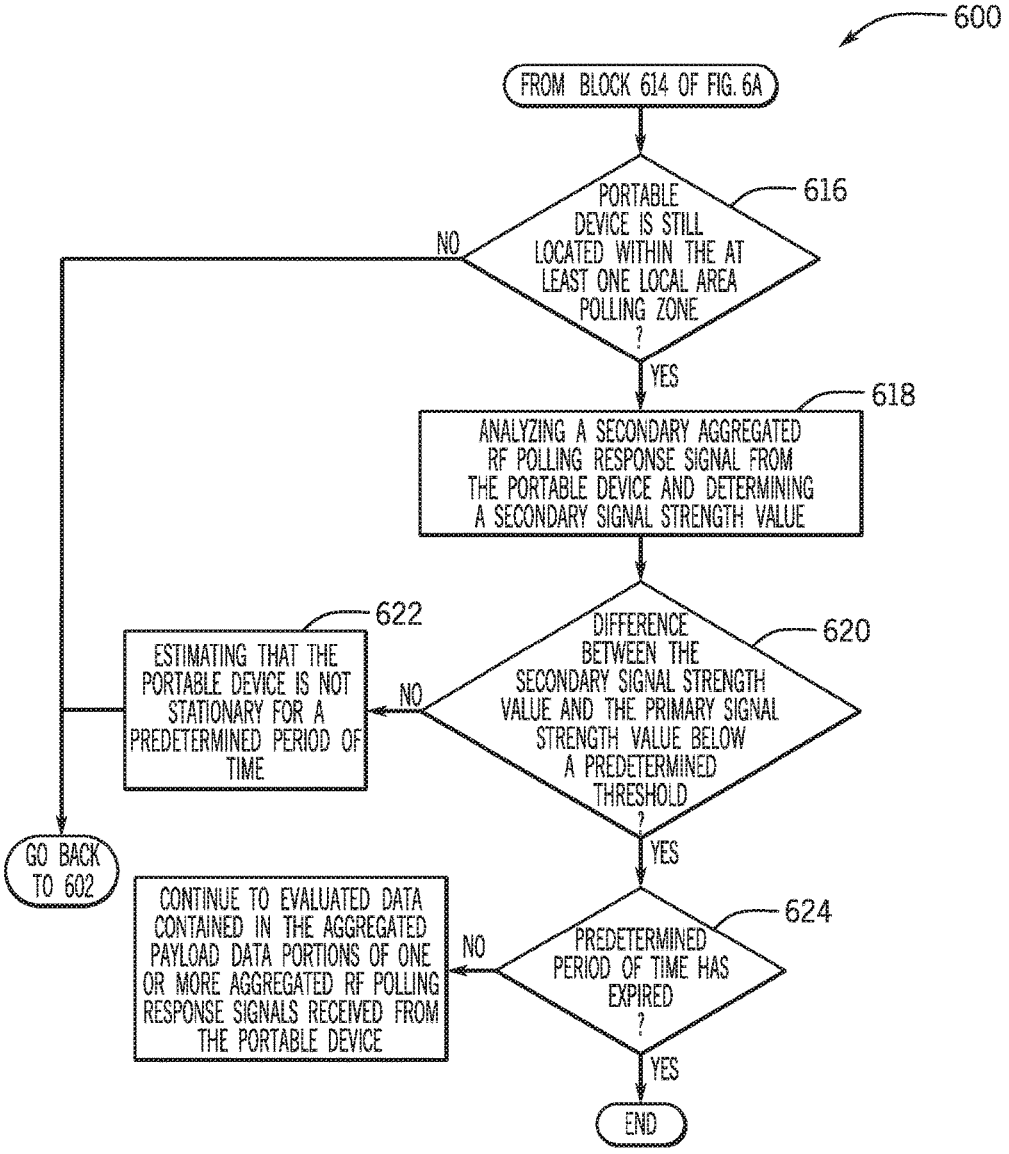
FIG. 6B is a process flow diagram of a second part of a method for providing hands free powered opening of at least one vehicle door during enablement of the energy efficient mode of the portable device according to an exemplary embodiment of the present disclosure.

FIG. 6B is a process flow diagram of a second part of the method 600 for providing hands free powered opening of at least one vehicle door 104*a*-104*e* during enablement of the energy efficient mode of the portable device 126 according to an exemplary embodiment of the present disclosure. FIG. 6B will also be described with reference to the components of FIGS. 1-3 though it is to be appreciated that the method 600 of FIG. 6B may be used with other systems and/or components.

As shown in FIG. 6B, the method 600 may proceed to block 616, wherein the method 600 may include determining if the portable device 126 is still located within the at least one local area polling zone(s) 132*a*-132*f*. In one embodiment, the polling signal module 304 may send a command signal(s) to the communication control unit 114 to initiate transmission of a pair of high power LF polling signals by the transceiver(s) 118*a*-118*h*. Upon receipt of the command signal(s), the communication control unit 114 may utilize the transceiver(s) 118*a*-118*h* that are in close proximity to the local area polling zone(s) 132*a*-132*e* in which the portable device 126 is determined to be located to transmit the pair of high power LF polling signals. The one or more high power LF polling signals may reach the entirety of respective local area polling zone(s) 132*a*-132*f* in which the portable device 126 is determined to be located.

If the portable device 126 is still located within the respective local area polling zone(s) 132*a*-132*f*, upon receiving the at least one pair of high power LF polling signals, the RF transceiver 210 of the portable device 126 may transmit an aggregated RF polling response signal to the transceiver(s) 118*a*-118*h*. Upon receipt of the aggregated RF polling response signal by the transceiver(s) 118*a*-118*h* that are in close proximity to the local area polling zone(s) 132*a*-132*e* in which the portable device 126 is determined to be located, data contained within the aggregated payload portion of the aggregated RF polling response signal may be communicated to the polling signal module 304 by the communication control unit 114.

The polling signal module 304 may determine that the portable device 126 is still located within at least one local area polling zone(s) 132*a*-132*e* in which it was determined to be located (as discussed with reference to block 608) based on the receipt of the data from the aggregated data payload portion of the received aggregated RF polling response signal. Conversely, if the portable device 126 is no longer located within the respective local area polling zone(s) 132*a*-132*f*, the polling signal module 304 will not receive the data from the aggregated data payload portion of the received aggregated RF polling response signal and may therefore determine that the portable device 126 is no longer located within the local area polling zone(s) 132*a*-132*f*.

In the circumstance in which the portable device 126 is no longer located within the respective local area polling zone(s) 132*a*-132*d*, the method 600 may revert to block 602, wherein the method 600 may include transmitting at least one pair of low power LF polling signals to the portable device 126. In one or more embodiments, when it is determined that the portable device 126 is no longer located with the respective local area polling zone(s) 132*a*-132*d*, the polling signal module 304 may send a signal(s) to the door actuation module 306 to lock the respective vehicle door(s) 104*a*-104*e* that was previously unlocked based on the evaluation of the signal strength of the aggregated RF polling response signal (as discussed with respect to block 608).

In one embodiment, upon receipt of the signal(s), the door actuation module 306 may determine the vehicle door(s) 104*a*-104*e* that was previously unlocked that are in closest proximity to the local area polling zone(s) 132*a*-132*f* in which the portable device 126 was determined to be located (as discussed with respect to block 608). The door actuation module 306 may send a signal(s) to the power control unit 112 to supply a predetermined amount of power to the motor(s) 106*a*-106*e* associated with the vehicle door(s) 104*a*-104*e* to lock the lock(s) 122*a*-122*e* of the respective vehicle door(s) 104*a*-104*e*.

With continued reference to the method 600 of FIG. 6B, if it is determined that the portable device 126 is still located within the at least one local area polling zone 132*a*-132*f* (at block 616), the method 600 may proceed to block 618, wherein the method 600 may include analyzing a second aggregated RF polling response signal from the portable device 126 and determining a secondary signal strength value. As discussed above, upon receipt of the aggregated RF polling response signal by the transceiver(s) 118*a*-118*h* that are in close proximity to the local area polling zone(s) 132*a*-132*e* in which the portable device 126 is determined to be located, data contained within the aggregated data payload portion of the aggregated RF polling response signal may be communicated to the polling signal module 304 by the communication control unit 114. Upon receiving the data pertaining to the aggregated RF polling response signal, the polling signal module 304 may identify the aggregated RF polling response signal as a secondary aggregated RF polling response signal that is a subsequently created aggregated RF polling response signal in response to the receipt of a subsequent pair of LF polling signals received by the portable device 126.

In one embodiment, the polling signal module 304 may analyze the secondary aggregated RF polling response signal and may determine the signal strength of the secondary aggregated RF polling response signal. Upon determining the signal strength of the secondary aggregated RF polling response signal, the polling signal module 304 may determine a secondary signal strength value that is indicative of the signal strength of the secondary aggregated RF polling response signal.

The method 600 may proceed to block 620, wherein the method 600 may include determining if a difference between the secondary signal strength value and the primary signal strength value is below a predetermined threshold. In an exemplary embodiment, the polling signal module 304 may access the storage unit 116 to retrieve the primary signal strength value which was previously stored on the storage unit 116 by the polling signal module 304 (as discussed at block 614). The polling signal module 304 may compute a difference between the secondary signal strength value and the primary signal strength value and output a primary/secondary difference value.

It is to be appreciated that in circumstances in which the polling signal module 304 determines that the portable device 126 is located within more than one of the local area polling zones 132*a*-132*f* (e.g., portable device 126 is located within and within the local area polling zone 132*a* and the local area polling zone 132*b*), the polling signal module 304 may access the storage unit 116 to retrieve the primary signal strength values associated with the transceivers 118*a*-118*h* that are in closest proximity to the local area polling zones 132*a*-132*f* (e.g., the transceiver 118*a* in closest proximity to the local area polling zone 132*a*, and the transceiver 118*b* in closest proximity to the local area polling zone 132*b*). The polling signal module 304 may compute a respective difference value between the secondary signal strength values and the primary signal strength values for each of the respective transceivers 118*a*-118*h*.

In an exemplary embodiment, upon computing the signal strength difference value of the secondary and the primary signal strength values, the polling signal module 304 may access the storage unit 116 to retrieve the one or more signal strength deviation threshold values that are associated with the transceiver(s) 118*a*-118*h* that are near to the local area polling zone(s) 132*a*-132*e* in which the portable device 126 is determined to be located. The one or more signal strength deviation threshold values may provide a maximum deviation of signal strength between two or more aggregated RF polling response signals to determine if the portable device 126 is stationary or moving within the one or more local area polling zones 132*a*-132*f*. It is to be appreciated that in circumstances in which the polling signal module 304 determines that the portable device 126 is located within more than one of the local area polling zones 132*a*-132*f*, the polling signal module 304 may access the storage unit 116 to retrieve the signal strength thresholds associated with the transceivers 118*a*-118*h* that are in closest proximity to the local area polling zones 132*a*-132*f*.

In one embodiment, upon retrieving the signal strength deviation threshold value(s), the polling signal module 304 may compare the primary/secondary difference value(s) to the signal strength deviation threshold value(s). If the polling signal module 304 determines that the primary/secondary differential value(s) is below the signal strength deviation threshold value(s), the polling signal module 304 may determine that the primary/secondary difference value(s) is within a predetermined stationary range and that the portable device 126 is remaining stationary. The predetermined stationary range may include a range of difference values that may indicate an estimation that the portable device 126 is remaining in a stationary position within the respective local area polling zone(s) 132*a*-132*f*.

As an illustrative example, polling signal module 304 may determine the difference between the secondary signal strength value and the primary signal strength value and may output the primary/secondary difference value of 40 h. The polling signal module 304 may compare the primary/secondary difference value of 40 h against the signal strength deviation threshold value of 100 h and may determine that the portable device 126 is within the predetermined stationary range (−100 h to 100 h) and that the portable device 126 is remaining stationary.

If it is determined that the difference between the secondary signal strength value and the primary signal strength value is not below the predetermined threshold (at block 620), the method 600 may proceed to block 622, wherein the method 600 may include estimating that the portable device 126 is not stationary within the at least one local area polling zone 132*a*-132*f*. In one embodiment, if the polling signal module 304 determines that the primary/secondary difference value is above the signal strength deviation threshold value(s), the polling signal module 304 may determine that the primary/secondary difference value is not within the predetermined stationary range. Therefore, the polling signal module 304 may determine that the portable device 126 is not remaining stationary. The method 600 may then revert back to block 602, wherein the method 600 may once again include transmitting at least one pair of low power LF polling signals to the portable device 126, as discussed in detail above.

With continued reference to FIG. 6B, if it is determined that the difference between the secondary signal strength value and the primary signal strength value is below the predetermined threshold (at block 620), the method 600 may proceed to block 626, wherein the method 600 may include determining if a predetermined period of time has expired. The predetermined period of time utilized by the polling signal module 304 may be an amount of time that is deemed to be appropriate for the individual carrying the portable device 126 to be stationary within the one or more of the local zones 132*a*-132*h* in order to safely actuate powered opening of one or more vehicle doors 104*a*-104*e* determined to be located in closest proximity to the portable device 126. As discussed above, the polling signal module 304 may execute the timer that is utilized to determine if the predetermined period of time has expired to determine if the portable device 126 remains stationary for the predetermined period of time.

In an exemplary embodiment, upon determining that the position of the portable device 126 is stationary for the predetermined period of time based upon determining that the predetermined period of time has expired (at block 624), the polling signal module 304 may communicate with the door actuation module 306 to determine if the vehicle door(s) 104*a*-104*e* that is located in close proximity to the location of the portable device 126 is closed. If the polling signal module 304 determines that the respective vehicle door(s) 104*a*-140*e* is closed, the polling signal module 304 may send an actuation command to the door actuation module 306 to actuate powered opening of the vehicle door(s) 104*a*-104*e* that is located in close proximity to the location of the portable device 126. In some embodiments, the polling signal module 304 may only send the actuation command to the door actuation module 306 upon determining that the location of the portable device 126 is not within one of the door area zones 134*a*-134*e* that may include the space occupied by the respective vehicle door(s) 104*a*-104*e* as it is being opened to ensure that opening of the respective vehicle door(s) 104*a*-104*e* may not be physically obstructed by the individual that may be carrying the portable device 126.

In one embodiment, upon receipt of the actuation command from the polling signal module 304, the door actuation module 306 may send one or more command signals to the power control unit 112 of the vehicle 102 to provide a first requisite amount of power to the respective motor(s) 106*a*-106*e* to start opening the vehicle door(s) 104*a*-104*e* that is located in close proximity to the location of the portable device 126, based on the utilization of the signal strength thresholds, as discussed above.

In an illustrative example, once it is determined that the portable device 126 is stationary (e.g., standing still possibly waiting for the tailgate door 104*e* to be opened) for the predetermined period of time and that the portable device 126 is not located within the door area zone 134*e*, the motor 106*e* is provided the first requisite amount of power to start opening the tailgate door 104*e* so that the tailgate door 104*e* that is configured as a lift gate door (starts to lift into an open position.

In one embodiment, if the polling signal module 304 determines that the position of the portable device 126 is stationary for the predetermined period of time (at block 624), the polling signal module 304 may communicate with the door actuation module 306 to determine if the vehicle door(s) 104*a*-104*e* that is located in close proximity to the location of the portable device 126 is open. If the polling signal module 304 determines that the respective vehicle door(s) 104*a*-140*e* is open, the polling signal module 304 may send one or more respective signals to the door actuation module 306 to actuate powered closing of the vehicle door(s) 104*a*-104*e*. More specifically, the polling signal module 304 may send a command signal(s) to the door actuation module 306 to actuate the powered closing of the respective vehicle door(s) 104*a*-104*e*.

In some embodiments, the polling signal module 304 may only send the actuation command to the door actuation module 306 upon determining that the location of the portable device 126 is not within the respective door area zone(s) 134*a*-134*e* that include the space occupied by the respective vehicle door(s) 104*a*-104*e* as it is being closed to ensure that closing of the respective vehicle door(s) 104*a*-104*e* may not be physically obstructed by the individual that may be carrying the portable device 126. In an exemplary embodiment, upon receiving the command signal(s) from the polling signal module 304, the door actuation module 306 may send one or more command signals to the power control unit 112 to provide a second requisite amount of power to the motor(s) 106*a*-106*e* to start powered closing the respective vehicle door(s) 104*a*-104*e*.

In an illustrative example, once it is determined that the portable device 126 is stationary (e.g., individual carrying the portable device 126 is standing still possibly waiting for the tailgate door 104*e* to be opened) for the predetermined period of time and that the portable device 126 is not located within door area zone 134*e* that includes the space occupied by the tailgate door 104*e* when it may be closed, the motor 106*e* is provided the second requisite amount of power to start closing the tailgate door 104*e* so that the tailgate door 104*e* that is configured as a lift gate door starts to drop into a closed position.

If it is determined that the predetermined period of time has not expired (at block 624 of FIG. 6B), the polling signal module 304 may continue the portable device polling mode to continue to evaluate data contained in the aggregated data payload portions of one or more aggregated RF polling response signals received from the portable device 126 to determine if the portable device 126 remains stationary for the duration of the predetermined period of time. Accordingly, it is contemplated that the method 600 may continue by determining if the predetermined period of time has expired for the polling signal module 304 to continue to analyze one or more additional subsequent LF polling response signals (e.g., third, fourth, fifth, sixth, etc. number of subsequently created and received aggregated RF response polling signals) from the portable device 126 in a similar manner as discussed above until the expiration of the predetermined period of time is determined.

It is to be appreciated that the process of method 600 may be utilized to open or close the vehicle door(s) 104*a*-104*e*. With respect to the closing of the vehicle door(s) 104*a*-104*e*, the polling signal module 304 may analyze a number of aggregated RF polling signals against the signal strength thresholds to determine that the portable device 126 is located outside of the one or more door area zones 134*a*-134*e* and the portable device 126 remains stationary for a second predetermined period of time to actuate closing of the vehicle door(s) 104*a*-104*e*.

In one embodiment, if the polling signal module 304 determines the vehicle door(s) 104*a*-104*e* is open and that the portable device 126 is remaining stationary for the second predetermined period of time within the local area polling zone(s) 132*a*-132*f* and outside of the door area zone(s) 134*a*-134*e*, the polling signal module 304 may send one or more respective signals to the door actuation module 306 to actuate powered closing of the vehicle door(s) 104*a*-104*e*. The polling signal module 304 may send a command signal(s) to the door actuation module 306 to actuate the powered closing of the respective vehicle door(s) 104*a*-104*e*. In particular, the second amount of power may be supplied to the motor 106*a*-106*e* associated with the at least one vehicle door 104*a*-104*e* to close the at least one vehicle door 104*a*-104*e*.

Figure 7:
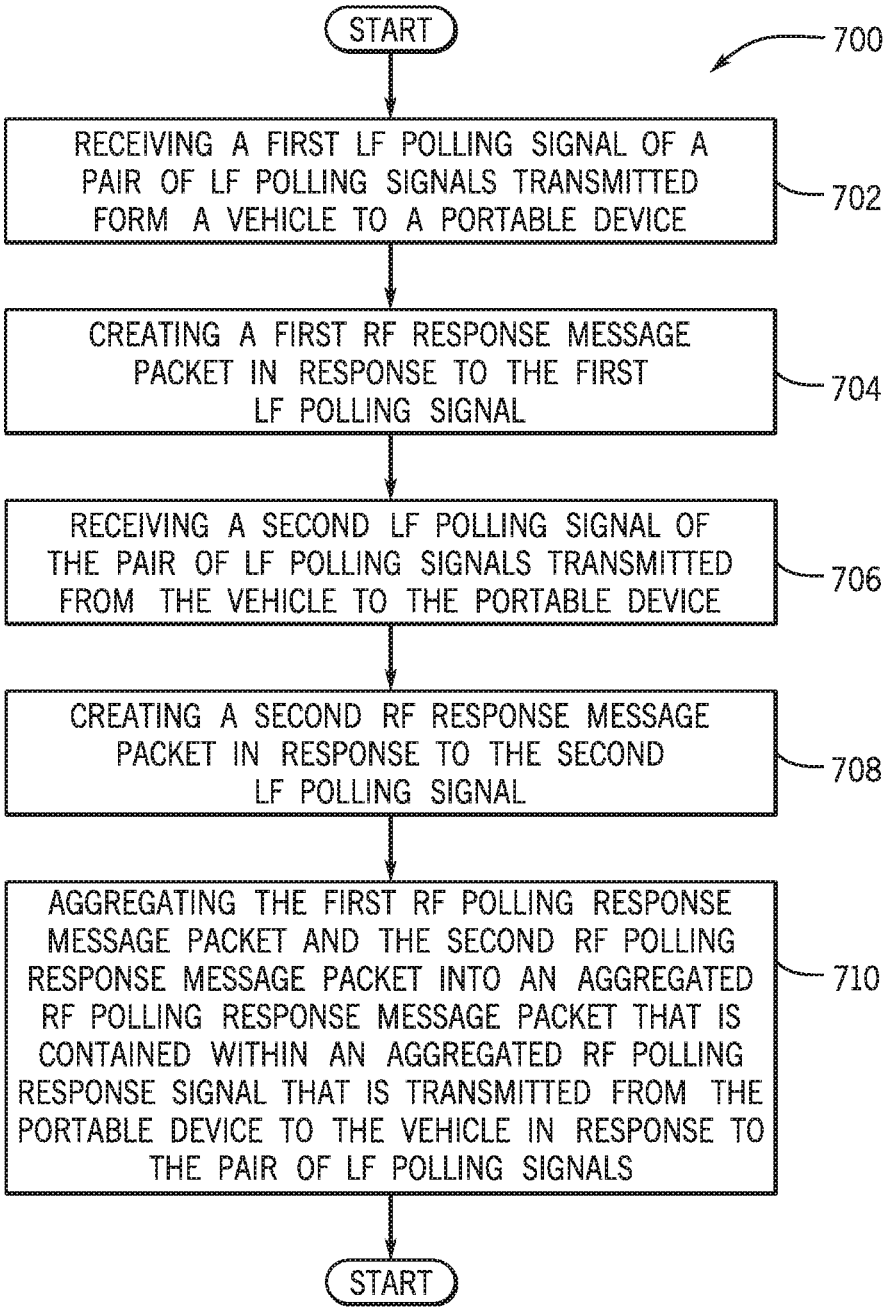
FIG. 7 is a process flow diagram of a method for providing energy efficient hands free vehicle door operation according to an exemplary embodiment of the present disclosure.

FIG. 7 is a process flow diagram of a method 700 for providing energy efficient hands free vehicle door operation according to an exemplary embodiment of the present disclosure. FIG. 7 may be executed by the components of FIGS. 1-3 though it is to be appreciated that the method of FIG. 7 may be executed with other systems and/or components. The method 700 may begin at block 702, wherein the method includes receiving a first LF polling signal of a pair of LF polling signals transmitted from a vehicle 102 to a portable device 126. The method 700 may proceed to block 704, wherein the method 700 may include creating a first RF response message packet in response to the first LF polling signal. The method 700 may proceed to block 706, wherein the method 700 may include receiving a second LF polling signal of the pair of LF polling signals transmitted from the vehicle 102 to the portable device 126. The method 700 may proceed to block 708, wherein the method 700 includes creating a second RF response message packet in response to the second LF polling signal. The method 700 may proceed to block 710, wherein the method 700 may include aggregating the first RF polling response message packet and the second RF polling response message packet into an aggregated RF polling response message packet that is contained within an aggregated RF polling response signal that is transmitted from the portable device 126 to the vehicle 102 in response to the pair of LF polling signals.

The embodiments discussed herein may also be described and implemented in the context of non-transitory computer-readable storage medium storing computer-executable instructions. Non-transitory computer-readable storage media includes computer storage media and communication media. For example, flash memory drives, digital versatile discs (DVDs), compact discs (CDs), floppy disks, and tape cassettes. Non-transitory computer-readable storage media may include volatile and nonvolatile, removable and non-removable media implemented in any method or technology for storage of information such as computer readable instructions, data structures, modules or other data. Non-transitory computer readable storage media excludes transitory and propagated data signals.

It can be appreciated that various implementations of the above-disclosed and other features and functions, or alternatives or varieties thereof, can be desirably combined into many other different systems or applications. Also that various presently unforeseen or unanticipated alternatives, modifications, variations, or improvements therein can be subsequently made by those skilled in the art.

The invention claimed is:

1. A computer-implemented method for providing energy efficient hands free vehicle door operation comprising:

receiving a first LF polling signal of a pair of LF polling signals transmitted from a vehicle to a portable device;

creating a first RF polling response message packet in response to the first LF polling signal, wherein the first RF polling response message packet includes a first data payload portion that includes data that pertains to a location of the portable device;

receiving a second LF polling signal of the pair of LF polling signals transmitted from the vehicle to the portable device;

creating a second RF polling response message packet in response to the second LF polling signal, wherein the second RF polling response message packet includes a second data payload portion that includes data that pertains to the location of the portable device; and aggregating the first RF polling response message packet and the second RF polling response message packet into an aggregated RF polling response message packet that is contained within an aggregated RF polling response signal that is transmitted from the portable device to the vehicle in response to the pair of LF polling signals, wherein a received signal strength of the aggregated RF polling response signal is evaluated to determine actuation of a powered unlocking, opening, locking and closing of at least one vehicle door.

2. The computer-implemented method of claim 1, wherein receiving the first LF polling signal of the pair of LF polling signals includes receiving at least one of: a first high powered LF polling signal that is transmitted to the portable device to determine if the portable device is located within a wide area polling zone, and a first low powered LF polling signal that is transmitted to the portable device to determine if the portable device is located within at least one local area polling zone of the vehicle.

3. The computer-implemented method of claim 1, wherein creating the first RF polling response message packet includes creating the first RF polling response message packet with a plurality of portions, wherein the plurality of portions include the first data payload portion, a header portion, a fixed code portion, a rolling code portion, a data payload portion, and a check-sum portion.

4. The computer-implemented method of claim 1, wherein receiving the second LF polling signal of the pair of LF polling signals includes receiving at least one of: a second high powered LF polling signal that is transmitted to the portable device to determine if the portable device is located within a wide area polling zone, and a second low powered LF polling signal that is transmitted to the portable device to determine if the portable device is located within at least one local area polling zone of the vehicle.

5. The computer-implemented method of claim 1, wherein creating the second RF polling response message packet includes creating the second RF polling response message packet with a plurality of portions, wherein the plurality of portions include the second data payload portion, a header portion, a fixed code portion, a rolling code portion, a data payload portion, and a check-sum portion.

6. The computer-implemented method of claim 1, wherein aggregating the first RF polling response message packet and the second RF polling response message packet includes partially creating the aggregated RF response message packet with a header portion, a fixed code portion, a rolling code portion, and a check-sum portion of the first RF polling response message packet and aggregating the first data payload portion of the first RF response message packet and the second data payload portion of the second RF response message packet into an aggregated data payload portion.

7. The computer-implemented method of claim 1, wherein aggregating the first RF polling response message packet and the second RF polling response message packet includes completing creation of the aggregated RF response message packet with a header portion, a fixed code portion, a rolling code portion and a check-sum portion of the second RF polling response message packet, wherein the aggregated RF response message contains the aggregated data payload portion based on the aggregation of the first data payload portion of the first RF response message packet and the second data payload portion of the second RF response message packet.

8. The computer-implemented method of claim 1, further including evaluating a received signal strength difference value between the aggregated RF response signal and a subsequently created aggregated RF response signal to determine if the portable device is stationary for a predetermined period of time within at least one local area polling zone of the vehicle.

9. The computer-implemented method of claim 8, further including supplying an amount of power to a motor associated with the at least one vehicle door to open or close the at least one vehicle door if it is determined that the portable device is stationary for the predetermined period of time.

10. A system for providing energy efficient hands free vehicle door operation comprising:

a memory storing instructions when executed by a processor cause the processor to:

receive a first LF polling signal of a pair of LF polling signals transmitted from a vehicle to a portable device;

create a first RF polling response message packet in response to the first LF polling signal, wherein the first RF polling response message packet includes a first data payload portion that includes data that pertains to a location of the portable device;

receive a second LF polling signal of the pair of LF polling signals transmitted from the vehicle to the portable device;

create a second RF polling response message packet in response to the second LF polling signal, wherein the second RF polling response message packet includes a second data payload portion that includes data that pertains to the location of the portable device; and aggregate the first RF polling response message packet and the second RF polling response message packet into an aggregated RF polling response message packet that is contained within an aggregated RF polling response signal that is transmitted from the portable device to the vehicle in response to the pair of LF polling signals, wherein a received signal strength of the aggregated RF polling response signal is evaluated to determine actuation of a powered unlocking, opening, locking and closing of at least one vehicle door.

11. The system of claim 10, wherein receiving the first LF polling signal of the pair of LF polling signals includes receiving at least one of: a first high powered LF polling signal that is transmitted to the portable device to determine if the portable device is located within a wide area polling zone, and a first low powered LF polling signal that is transmitted to the portable device to determine if the portable device is located within at least one local area polling zone of the vehicle.

12. The system of claim 10, wherein creating the first RF polling response message packet includes creating the first RF polling response message packet with a plurality of portions, wherein the plurality of portions include the first data payload portion, a header portion, a fixed code portion, a rolling code portion, a data payload portion, and a check-sum portion.

13. The system of claim 10, wherein receiving the second LF polling signal of the pair of LF polling signals includes receiving at least one of: a second high powered LF polling signal that is transmitted to the portable device to determine if the portable device is located within a wide area polling zone, and a second low powered LF polling signal that is transmitted to the portable device to determine if the portable device is located within at least one local area polling zone of the vehicle.

14. The system of claim 10, wherein creating the second RF polling response message packet includes creating the second RF polling response message packet with a plurality of portions, wherein the plurality of portions include the second data payload portion, a header portion, a fixed code portion, a rolling code portion, a data payload portion, and a check-sum portion.

15. The system of claim 10, wherein aggregating the first RF polling response message packet and the second RF polling response message packet includes partially creating the aggregated RF response message packet with a header portion, a fixed code portion, a rolling code portion, and a check-sum portion of the first RF polling response message packet and aggregating the first data payload portion of the first RF response message packet and the second data payload portion of the second RF response message packet into an aggregated data payload portion.

16. The system of claim 10, wherein aggregating the first RF polling response message packet and the second RF polling response message packet includes completing creation of the aggregated RF response message packet with a header portion, a fixed code portion, a rolling code portion and a check-sum portion of the second RF polling response message packet, wherein the aggregated RF response message contains the aggregated data payload portion based on the aggregation of the first data payload portion of the first RF response message packet and the second data payload portion of the second RF response message packet.

17. The system of claim 10, further including evaluating a received signal strength difference value between the aggregated RF response signal and a subsequently created aggregated RF response signal to determine if the portable device is stationary for a predetermined period of time within at least one local area polling zone of the vehicle.

18. The system of claim 10, further including supplying an amount of power to a motor associated with the at least one vehicle door to open or close the at least one vehicle door if it is determined that the portable device is stationary for the predetermined period of time.

19. A non-transitory computer readable storage medium storing instructions that, when executed by a computer, which includes at least a processor, causes the computer to perform a method, the method comprising:

receiving a first LF polling signal of a pair of LF polling signals transmitted from a vehicle to a portable device;

creating a first RF polling response message packet in response to the first LF polling signal, wherein the first RF polling response message packet includes a first data payload portion that includes data that pertains to a location of the portable device;

receiving a second LF polling signal of the pair of LF polling signals transmitted from the vehicle to the portable device;

creating a second RF polling response message packet in response to the second LF polling signal, wherein the second RF polling response message packet includes a second data payload portion that includes data that pertains to the location of the portable device; and aggregating the first RF polling response message packet and the second RF polling response message packet into an aggregated RF polling response message packet that is contained within an aggregated RF polling response signal that is transmitted from the portable device to the vehicle in response to the pair of LF polling signals, wherein a received signal strength of the aggregated RF polling response signal is evaluated to determine actuation of a powered unlocking, opening, locking and closing of at least one vehicle door.

20. The non-transitory computer readable storage medium of claim 19, wherein aggregating the first RF polling response message packet and the second RF polling response message packet includes aggregating the first data payload portion of the first RF response message packet and the second data payload portion of the second RF response message packet into an aggregated data payload portion, wherein the aggregated RF response message contains the aggregated data payload portion.

* * * * *